US007806672B2

(12) United States Patent
Furusho et al.

(10) Patent No.: US 7,806,672 B2
(45) Date of Patent: Oct. 5, 2010

(54) ROTARY COMPRESSOR WITH PRESSING MECHANISM AND ADJUSTING MECHANISM TO VARY A MAGNITUDE OF A LOAD IN RESPONSE TO A PRESSURE DIFFERENCE BETWEEN THE SUCTION FLUID AND DISCHARGE FLUID

(75) Inventors: Kazuhiro Furusho, Sakai (JP); Takazo Sotojima, Sakai (JP); Takashi Shimizu, Sakai (JP); Kazutaka Hori, Sakai (JP); Yoshitaka Shibamoto, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 447 days.

(21) Appl. No.: 11/915,178

(22) PCT Filed: May 23, 2006

(86) PCT No.: PCT/JP2006/310235

§ 371 (c)(1),
(2), (4) Date: Nov. 21, 2007

(87) PCT Pub. No.: WO2006/126531

PCT Pub. Date: Nov. 30, 2006

(65) Prior Publication Data

US 2009/0142214 A1 Jun. 4, 2009

(30) Foreign Application Priority Data

May 23, 2005 (JP) ..... 2005-149793
Oct. 20, 2005 (JP) ..... 2005-306123

(51) Int. Cl.
*F03C 2/00* (2006.01)
*F04C 18/00* (2006.01)
*F04C 2/00* (2006.01)

(52) U.S. Cl. ..... 418/59; 418/270

(58) Field of Classification Search ..... 418/57–59, 418/55.5, 62, 63, 104, 270
See application file for complete search history.

(56) References Cited

U.S. PATENT DOCUMENTS 300,628 A * 6/1884 Nash ..... 418/59

(Continued)

FOREIGN PATENT DOCUMENTS

JP 59147893 A * 8/1984

(Continued)

*Primary Examiner*—Theresa Trieu
(74) *Attorney, Agent, or Firm*—Global IP Counselors

(57) ABSTRACT

In a compression mechanism of a rotary compressor, a cylinder chamber is defined by a cylinder and a second housing. A back surface side gap is defined between an end plate part of the cylinder and a flat plate part of a first housing. The first housing is provided with a communicating path and a differential pressure regulating valve. When the difference between the suction pressure and the discharge pressure is small, the discharge pressure is introduced through the communicating path to an intermediate gap whereby both an internal gap and the intermediate gap are placed at the same pressure as the discharge pressure. Conversely, when the difference between the discharge pressure and the suction pressure is great, the communicating path is made discontinuous by the differential pressure regulating valve whereby the intermediate gap is placed at an intermediate pressure lower than the discharge pressure.

12 Claims, 12 Drawing Sheets

U.S. PATENT DOCUMENTS

| | | | | |
|---|---|---|---|---|
| 1,229,676 | A * | 6/1917 | Tice | 418/59 |
| 3,125,031 | A * | 3/1964 | Rydberg et al. | 418/59 |
| 7,549,851 | B2 * | 6/2009 | Masuda | 418/59 |

FOREIGN PATENT DOCUMENTS

| | | | |
|---|---|---|---|
| JP | 60-90584 | U | 6/1985 |
| JP | 60228788 | A * | 11/1985 |
| JP | 06-288358 | A | 10/1994 |
| JP | 08-021382 | A | 1/1996 |
| JP | 08-061257 | A | 3/1996 |
| JP | 11-190285 | A | 7/1999 |
| JP | 2003-343457 | A | 12/2003 |

* cited by examiner

ROTARY COMPRESSOR WITH PRESSING MECHANISM AND ADJUSTING MECHANISM TO VARY A MAGNITUDE OF A LOAD IN RESPONSE TO A PRESSURE DIFFERENCE BETWEEN THE SUCTION FLUID AND DISCHARGE FLUID

CROSS-REFERENCE TO RELATED APPLICATIONS

This U.S. National stage application claims priority under 35 U.S.C. §119(a) to Japanese Patent Application Nos. 2005-149793, filed in Japan on May 23, 2005, and 2005-305123, filed in Japan on Oct. 20, 2005, the entire contents of which are hereby incorporated herein by reference.

TECHNICAL FIELD

The present invention relates to rotary compressors for compressing fluid by relative eccentric rotation of a cylinder and a piston.

BACKGROUND ART

In the past, a rotary compressor, as disclosed for example in Japanese patent document No. JP-A-H06-288358, has been known in the art. This rotary compressor is equipped with a cylinder and a piston member which is rotated eccentrically. The cylinder and the piston member together define a compression chamber which is a closed space. In addition, the cylinder and the piston member are provided with end walls. The end wall of the cylinder and the end wall of the piston member face each other across the compression chamber. And, the rotary compressor causes the piston member to rotate eccentrically to thereby compress fluid drawn in to the compression chamber.

In the rotary compressor, the internal pressure of the compression chamber is applied to both of the end wall of the cylinder and the end wall of the piston member. Upon compression of the fluid in the compression chamber, the internal pressure of the compression chamber becomes higher. Consequently, if no countermeasures are taken, the cylinder and the piston member will be moved in opposite directions away from each other by the pressure applied to each of the end walls. As a result, the gas-tightness of the compression chamber is no longer maintained, thereby causing a drop in the efficiency of compression.

Therefore, in the rotary compressor disclosed in the aforesaid patent document, pushing force is applied to the end wall of the piston member to avoid expansion of the clearance between the piston member and the cylinder, thereby ensuring the gas-tightness of the compression chamber.

SUMMARY OF THE INVENTION

Problems That the Invention Seeks to Overcome

The rotary compressor draws in and compresses fluid of low pressure. Fluid compressed to high pressure is discharged from the rotary compressor. The pressure of suction fluid which is drawn in to the cylinder chamber and the pressure of discharge fluid which is discharged from the cylinder chamber may vary depending on where the rotary compressor is applied. For example, in the case where the rotary compressor is employed as a compressor for an air conditioner which performs a refrigeration cycle, the pressure of suction fluid and the pressure discharge fluid vary depending on the operating condition of the air conditioner.

The pressure of suction fluid and the pressure of discharge fluid vary with an accompanying variation in the magnitude of pushing force to be applied to the piston member. Consequently, in the rotary compressor of the aforesaid patent document, the pushing force which is applied to the piston member may become excessive depending on the operating condition. In such a case, the friction between the piston member and the cylinder grows, which may result in an increase in the mechanical loss.

With the above drawbacks in mind, the present invention was devised. Accordingly, an object of the present invention is to ensure high compression efficiency without any increase in the mechanical loss even when the operating condition of the rotary compressor varies.

Means for Overcoming the Problems

The present invention provides, as a first aspect, a rotary compressor comprising: a cylinder (40) which defines a cylinder chamber (60, 65); a piston (50) which is accommodated in an eccentric manner relative to the cylinder (40) in the cylinder chamber (60, 65); and a blade (45) for division of the cylinder chamber (60, 65) into a high pressure chamber (61, 66) and a low pressure chamber (62, 67), wherein the volume of the high pressure chamber (61, 66) and the volume of the low pressure chamber (62, 67) are varied by relative eccentric rotation of the cylinder (40) and the piston (50). In the rotary compressor of the first aspect, the cylinder (40) and the piston (50) are provided, on their base end sides, with end plate parts and the front surface of the end plate part (41) of the cylinder (40) and the front surface of the end plate part (51) of the piston (50) face each other across the cylinder chamber (60, 65); one of the cylinder (40) and the piston (50) constitutes a pushing side member while the other of the cylinder (40) and the piston (50) constitutes a receiving side member; and the rotary compressor further comprises (a) a pressing mechanism (70) by which the pushing side member is pushed towards the end plate part of the receiving side member and (b) an adjusting mechanism (80) by which the magnitude of load which is applied in the direction towards the end plate part of the receiving side member to the pushing side member is varied in response to the difference in pressure between suction fluid which is drawn in to the low pressure chamber (62, 67) and discharge fluid which is discharged from the high pressure chamber (61, 66).

In the first aspect of the present invention, the cylinder chamber (60, 65) enclosed by the cylinder (40) and the piston (50) is divided by the blade (45) into the high pressure chamber (61, 66) and the low pressure chamber (62, 67). As the cylinder (40) and the piston (50) are rotated in relative eccentric manner, the high pressure chamber (61, 66) and the low pressure chamber (62, 67) are varied in their volume. In the process in which the volume of the low pressure chamber (62, 67) expands, fluid is drawn in to the low pressure chamber (62, 67) while on the other hand in the process in which the volume of the high pressure chamber (61, 66) shrinks, fluid in the high pressure chamber (61, 66) is compressed. The pressure of fluid in the high pressure chamber (61, 66) is applied to both the end plate part (41) of the cylinder (40) and the end plate part (51) of the piston (50) in directions so that they are drawn apart from each other.

Meanwhile, the rotary compressor (10) of the present aspect is provided with the pressing mechanism (70). The pressing mechanism (70) applies pushing force to either one of the cylinder (40) and the piston (50). In the present aspect, either the cylinder (40) or the piston (50), whichever receives pushing force from the pressing mechanism (70), serves as a pushing side member while the other serves as a receiving side member. In the case where the cylinder (40) becomes a pushing side member while the piston (50) becomes a receiving side member, the pressing mechanism (70) applies to the pushing side member, i.e., the cylinder (40), a pushing force in the direction towards the end plate part (51) of the receiving side member, i.e., the piston (50). Conversely, in the case where the piston (50) becomes a pushing side member while the cylinder (40) becomes a receiving side member, the pressing mechanism (70) applies to the pushing side member, i.e., the piston (50), a pushing force in the direction towards the end plate part (41) of the receiving side member, i.e., the cylinder (40). One of the cylinder (40) and the piston (50) is pushed by the pushing force of the pressing mechanism (70) towards the end plate part of the other of the cylinder (40) and the piston (50).

Here, in a rotary compressor (10) of the conventional type provided with what corresponds to the pressing mechanism (70), the magnitude of load in the direction towards the end plate part of the receiving side member, which load is a portion of the load applied to the pushing side member, is the resultant of forces which are received by the end plate part of the pushing side member, respectively, from the fluid in the high pressure chamber (61, 66) and from the pressing mechanism (70). And, if the force that the pushing side member receives from the pressing mechanism (70) becomes excessively greater than the force received from the fluid in the high pressure chamber (61, 66), the frictional force acting between the pushing side member and the receiving side member increases. The loss of power due to the increased frictional force (i.e., frictional loss) will increase accordingly.

Therefore, the rotary compressor (10) of the present aspect is provided with the adjusting mechanism (80). The adjusting mechanism (80) adjusts the magnitude of load in the direction towards the end plate part of the receiving side member which load is a portion of the load applied to the pushing side member. At that time, the adjusting mechanism (80) adjusts the magnitude of the load in response to the difference between the pressure of suction fluid which is drawn in to the low pressure chamber (62, 67) (i.e., the suction pressure) and the pressure of discharge fluid which is discharged from the high pressure chamber (61, 66) (i.e., the discharge pressure).

The present invention provides, as a second aspect according to the first aspect, a rotary compressor in which the cylinder (40) is configured such that the cylinder chamber (60, 65) has a transverse cross-section in the form of a ring shape; the piston (50) is provided with a piston main body (52) which is formed in a ring shape to thereby divide the cylinder chamber (60, 65) into an external cylinder chamber (60) outside the piston (50) and an internal cylinder chamber (65) inside the piston (50); and the external cylinder chamber (60) and the internal cylinder chamber (65) are each divided by the blade (45) into a high pressure chamber (61, 66) and a low pressure chamber (62, 67).

In the second aspect of the present invention, the transverse cross-section of the cylinder chamber (60, 65) defined by the cylinder (40) (i.e. the cross-section orthogonal to the axial direction of the cylinder (40)) is in the form of a ring shape. The cylinder chamber (60, 65) is partitioned by the ring-shaped piston (50) into the external cylinder chamber (60) and the internal cylinder chamber (65). The external cylinder chamber (60) located on the outside of the piston (50) is partitioned by the blade (45) into the high pressure chamber (61) and the low pressure chamber (62). In addition, the internal cylinder chamber (65) located on the inside of the piston (50) is also portioned by the blade (45) into the high pressure chamber (66) and the low pressure chamber (67). As the piston (50) and the cylinder (40) are rotated in relative eccentric manner, the high pressure chambers (61, 66) and the low pressure chambers (62, 67) are varied in their volume, whereby the suction of fluid into the low pressure chambers (62, 67) and the compression of fluid in the high pressure chambers (61, 66) are carried out.

The present invention provides, as a third aspect according to either the first or the second aspect, a rotary compressor in which the adjusting mechanism (80) varies the magnitude of pushing force which is applied to the pushing side member by the pressing mechanism (70) whereby the magnitude of load which is applied in the direction towards the end plate part of the receiving side member to the pushing side member is varied.

In the third aspect of the present invention, the adjusting mechanism (80) varies the magnitude of pushing force itself that the pushing side member receives from the pressing mechanism (70). And, with the variation in the magnitude of pushing force of the pressing mechanism (70) made by the adjusting mechanism (80), the magnitude of load which is applied in the direction towards the end plate part of the receiving side member to the pushing side member is varied.

The present invention provides, as a fourth aspect according to the third aspect, a rotary compressor in which the pressing mechanism (70) is configured such that the pressure of the discharge fluid is applied to one portion of the back surface of the end plate part of the pushing side member while the pressure of the suction fluid is applied to the other portion and the adjusting mechanism (80) varies the area of a portion of the back surface of the end plate part of the pushing side member to which portion the pressure of the discharge fluid is applied whereby the magnitude of pushing force which is applied to the pushing side member by the pressing mechanism (70) is varied.

In the fourth aspect of the present invention, the pressing mechanism (70) is configured such that the pressure of discharge fluid and the pressure of suction fluid are applied to the back surface of the end plate part of the pushing side member, whereby pushing force is applied to the pushing side member. In addition, the adjusting mechanism (80) varies the area of a portion of the back surface of the end plate part of the pushing side member which portion receives the pressure of discharge fluid. If comparison is made for cases where the pressure of discharge fluid is at the same level, the magnitude of pushing force which is applied to the pushing side member becomes greater as the area of a portion of the back surface of the end plate part of the pushing side member which portion receives the pressure of discharge fluid increases.

The present invention provides, as a fifth aspect according to the fourth aspect, a rotary compressor in which a supporting member (35) is provided which is disposed along the back surface of the end plate part of the pushing side member to thereby define a back surface side gap (75) between itself and the entire back surface of the end plate part of the pushing side member; the pressing mechanism (70) is provided with a large-diameter seal ring (71) and a small-diameter seal ring (72) which are formed in respective ring shapes of different diameters and which are disposed in the back surface side gap (75) whereby the pressure of the discharge fluid is constantly applied to a portion of the back surface side gap (75) which portion is defined inside the small-diameter seal ring (72) while the pressure of the suction fluid is constantly applied to a portion of the back surface side gap (75) which portion is defined outside the large-diameter seal ring (71); and the adjusting mechanism (80) includes: (a) a communicating path (81) for connection of a portion of the back surface side gap (75) which portion is defined between the small-diameter seal ring (72) and the large-diameter seal ring (71) to a space where the discharge fluid is present and (b) an on-off valve (82) which is configured such that the communicating path (81) is opened if the difference in pressure between the discharge fluid and the suction fluid falls below a predetermined value while the communicating path (81) is closed if the pressure difference becomes equal to or greater than the predetermined value.

In the fifth aspect of the present invention, the back surface side gap (75) is defined between the supporting member (35) and the end plate part of the pushing side member. The back surface side gap (75) is partitioned by the large-diameter seal ring (71) and the small-diameter seal ring (72) into three portions. More specifically, the back surface side gap (75) is divided into a portion defined inside the small-diameter seal ring (72), a portion defined between the small-diameter seal ring (72) and the large-diameter seal ring (71), and a portion defined outside the large-diameter seal ring (71). In the back surface side gap (75), the portion defined inside the small-diameter seal ring (72) is placed at substantially the same pressure as the discharge fluid and the portion defined outside the large-diameter seal ring (71) is placed at substantially the same pressure as the suction fluid.

In the fifth aspect of the present invention, the adjusting mechanism (80) is provided with the communicating path (81) and the on-off valve (82).

When the difference in pressure between the suction fluid and the discharge fluid falls below the predetermined value, the on-off valve (82) opens the communicating path (81). In this state, the pressure of the discharge fluid is introduced into a portion of the back surface side gap (75) which portion is defined between the small-diameter seal ring (72) and the large-diameter seal ring (71). In other words, in the back surface side gap (75), the entire space inside the large-diameter seal ring (71) is placed at the same pressure as the discharge fluid and only the space outside the large-diameter seal ring (71) is placed at the same pressure as the suction fluid. If the area of a portion of the end plate part of the pushing side member to which portion the pressure of the discharge fluid is applied is fixed, the lack of pushing force which is applied to the pushing side member may possibly occur when the difference in pressure between the suction fluid and the discharge fluid is relatively small. Therefore, by the adjusting mechanism (80), the entire space inside the large-diameter seal ring (71) in the back surface side gap (75) is placed at the same pressure as the discharge fluid to thereby ensure the pushing force which is applied to the pushing side member.

Conversely, when the difference in pressure between the suction fluid and the discharge fluid becomes equal to or greater than the predetermined value, the on-off valve (82) closes the communicating path (81). In this state, the pressure in a portion of the back surface side gap (75) which portion is defined between the small-diameter seal ring (72) and the large-diameter seal ring (71) comes to have a value intermediate between the discharge fluid pressure and the suction fluid pressure. Stated another way, since the occurrence of fluid leakage cannot be prevented completely by means of the large- and small-diameter seal rings (71, 72), the pressure between the small-diameter seal ring (72) and the large-diameter seal ring (71) comes to have a value intermediate between the pressure inside the small-diameter seal ring (72) and the pressure outside the large-diameter seal ring (71). If the area of a portion of the end plate part of the pushing side member to which portion the discharge fluid pressure is applied is fixed, the excess of pushing force which is applied to the pushing side member may possibly occur when the difference in pressure between the discharge fluid and the suction fluid is relatively great. Therefore, by the adjusting mechanism (80), the pressure in a portion of the back surface side gap (75) which portion is defined between the small-diameter seal ring (72) and the large-diameter seal ring (71) is made lower than the discharge fluid pressure, whereby the pushing force which is applied to the pushing side member is reduced.

The present invention provides, as a sixth aspect according to either the first or the second aspect, a rotary compressor in which a supporting member (35) is provided which is disposed along the back surface of the end plate part of the pushing side member to thereby define a back surface side gap (75) between itself and the entire back surface of the end plate part of the pushing side member; the pressing mechanism (70) is configured such that the pushing side member is pushed towards the end plate part of the receiving side member by use of the pressure of fluid in the back surface side gap (75); a large-diameter seal ring (71) and a small-diameter seal ring (72) which are formed in respective ring shapes of different diameters are disposed in the back surface side gap (75); and the adjusting mechanism (80) varies the pressure of fluid in a portion of the back surface side gap (75) which portion is defined between the small-diameter seal ring (72) and the large-diameter seal ring (71) whereby the magnitude of pushing force which is applied to the pushing side member by the pressing mechanism (70) is varied.

In the sixth aspect of the present invention, the back surface side gap (75) is defined between the end plate part of the pushing side member and the supporting member (35). By the pressing mechanism (70), the pressure of fluid present in the back surface side gap (75) is applied to the back surface of the end plate part of the pushing side member whereby pushing force is applied to the pushing side member. On the other hand, the adjusting mechanism (80) is configured such that it adjusts the pressure of fluid in a portion of the back surface side gap (75) which portion is defined between the small-diameter seal ring (72) and the large-diameter seal ring (71). When the pressure of fluid in this portion varies, the force that the pushing side member receives from the fluid in the back surface side gap (75) varies, as a result of which the magnitude of load which is applied in the direction towards the end plate part of the receiving side member to the pushing side member is varied.

The present invention provides, as a seventh aspect according to the sixth aspect, a rotary compressor in which the center of the large-diameter seal ring (71) lies nearer the high pressure chamber (61, 66) than the center of rotation of either the cylinder (40) or the piston (50).

In the seventh aspect of the present invention, the center position of the large-diameter seal ring (71) is arranged such that it deviates towards the high pressure chamber (61, 66). Here, note that the fluid pressure which is applied to the end plate part of the piston (50) and to the end plate part of the cylinder (40) becomes greater on the side of the high pressure chamber (61, 66) than on the side of the low pressure chamber (62, 67). Consequently, there will still remain a moment that tries to cause the piston (50) or the cylinder (40) to tilt if the pushing force is just averagely applied to the end plate part of the piston (50) or the cylinder (40), whichever serves as a pushing side member. On the other hand, if the large-diameter seal ring (71) is arranged nearer the high pressure chamber (61, 66), the point of application of the pushing force which is applied to the end plate part of the pushing side member by the internal pressure of a portion of the back surface side gap (75) which portion is sandwiched between the small-diameter seal ring (72) and the large-diameter seal ring (71) lies at a position nearer the high pressure chamber (61, 66). Consequently, the moment that tries to cause the pushing side member to tilt is reduced.

The present invention provides, as an eighth aspect according to the fifth aspect, a rotary compressor in which the center of the large-diameter seal ring (71) and the center of the small-diameter seal ring (72) each lie nearer the high pressure chamber (61, 66) than the center of rotation of either the cylinder (40) or the piston (50) and the center of the small-diameter seal ring (72) lies nearer the blade (45) than the center of the large-diameter seal ring (71).

In the eighth aspect of the present invention, the large-diameter seal ring (71) and the small-diameter seal ring (72) are disposed such that their respective center positions deviate towards the high pressure chamber (61, 66). Here, note that the fluid pressure which is applied to the end plate part of the piston (50) and to the end plate part of the cylinder (40) becomes greater on the side of the high pressure chamber (61, 66) than on the side of the low pressure chamber (62, 67). Consequently, there will still remain a moment that tries to cause the piston (50) or the cylinder (40) to tilt if the pushing force is just averagely applied to the end plate part of the piston (50) or the cylinder (40), whichever serves as a pushing side member. On the other hand, if the large-diameter seal ring (71) and the small-diameter seal ring (72) are disposed such that they lie nearer the high pressure chamber (61, 66), the pushing force which is applied to a portion nearer the high pressure chamber (61, 66) becomes greater than a portion nearer the low pressure chamber (62, 67) in the end plate part of the pushing side member. Consequently, the moment that tries to cause the pushing side member to tilt is reduced.

In addition, in the eighth aspect of the present invention, the eccentric direction of the large-diameter seal ring (71) differs from the eccentric direction of the small-diameter seal ring (72). Consequently, the center of application of the pushing force which is applied to the end plate part of the pushing side member is varied differently between (a) a state in which only a potion of the back surface side gap (75), which portion is defined inside the small-diameter seal ring (72), is placed at the same pressure as the discharge fluid and (b) a state in which the entirety of a portion of the back surface side gap (75), which portion is defined inside the large-diameter seal ring (71), is placed at the same pressure as the discharge fluid. In other words, the position of the center of application of the pushing force which is applied to the end plate part of the pushing side member is varied in response to the difference in pressure between the suction fluid and the discharge fluid.

The present invention provides, as a ninth aspect according to either the first or the second aspect, a rotary compressor in which the adjusting mechanism (80) causes a pushing-back force in the direction away from the end plate part of the receiving side member to be applied to the pushing side member and varies the magnitude of the pushing-back force to thereby vary the magnitude of load which is applied in the direction towards the end plate part of the receiving side member to the pushing side member.

In the ninth aspect of the present invention, the adjusting mechanism (80) causes application of a pushing-back force of opposite direction to the pushing force from the pressing mechanism (70) to the pushing side member, thereby changing the magnitude of the pushing-back force. Since the pushing force by the pressing mechanism (70) and the pushing-back force of the adjusting mechanism (80) offset each other, the magnitude of load which is applied in the direction towards the end plate part of the receiving-side member to the pushing side member is varied when the magnitude of the pushing-back force is varied by the adjusting mechanism (80).

The present invention provides, as a tenth aspect according to the ninth aspect, a rotary compressor in which the adjusting mechanism (80) is provided with a concave groove (88) which opens at the tip surface of the receiving side member which comes into sliding contact with the front surface of the end plate part of the pushing side member whereby the internal pressure of the concave groove (88) is varied to thereby vary the magnitude of the pushing-back force.

In the tenth aspect of the present invention, the concave groove (88) has an opening at the tip surface of the receiving side member. The internal pressure of the concave groove (88) is applied to the front surface of the end plate part of the pushing side member. In other words, the direction of force which is applied to the pushing side member by the internal pressure of the concave groove (88) is the direction in which the end plate part of the pushing side member is moved away from the receiving side member. The adjusting mechanism (80) varies the internal pressure of the concave groove (88) to thereby cause the magnitude of pushing-back force which is applied to the pushing side member to vary.

The present invention provides, as an eleventh aspect according to the tenth aspect, a rotary compressor in which the concave groove (88) of the adjusting mechanism (80) is opened at a portion of the tip surface of the receiving side member which portion is situated nearer the low pressure chamber (62, 67) and the adjusting mechanism (80) includes a communicating path (81) for connection of the concave groove (88) to a space where the discharge fluid is present and an on-off valve (82) which is configured such that the communicating path (81) is opened if the difference in pressure between the discharge fluid and the suction fluid exceeds a predetermined value while the communicating path (81) is closed if the pressure difference becomes equal to or less than the predetermined value.

In the eleventh aspect of the present invention, the concave groove (88) is opened at a portion of the tip surface of the receiving side member which portion is situated nearer the low pressure chamber (62, 67). When the difference in pressure between the discharge fluid and the suction fluid becomes equal to or greater than the predetermined value, the communicating path (81) is placed in the open state by the on-off valve (82). In this state, the pressure of the discharge fluid is introduced through the communicating path (81) into the concave groove (88). If the difference in pressure between the discharge fluid and the suction fluid is relatively great, the internal pressure of the concave groove (88) is set at the same level as the pressure of the discharge fluid, to thereby increase the magnitude of pushing-back force of opposite direction to the pushing force of the pressing mechanism (70). Conversely, if the difference in pressure between the discharge fluid and the suction fluid falls below the predetermined value, the communicating path (81) is placed in the closed state by the on-off valve (82). In this state, the internal pressure of the concave groove (88) receives influence of the fluid pressure in the low pressure chamber (62, 67) and influence of the fluid pressure in the high pressure chamber (61, 66) and falls below the discharge fluid pressure. When the difference in pressure between the discharge fluid and the suction fluid is relatively small, the internal pressure of the concave groove (88) is made lower than the discharge fluid pressure, to thereby reduce the magnitude of pushing-back force of opposite direction to the pushing force of the pressing mechanism (70).

As described above, the fluid pressure which is applied to the front surface of the end plate part of the pushing side member which is either the piston (50) or the cylinder (40) is smaller on the side of the low pressure chamber (62, 67) than on the side of the high pressure chamber (61, 66). On the other hand, in the present aspect, the concave groove (88) is opened at a portion of the tip surface of the receiving side member which portion is situated nearer the low pressure chamber (62, 67). And, when the pressure of the discharge fluid is introduced through the communicating path (81) into the concave groove (88), the pushing-back force which is applied to a portion of the end plate part of the pushing side member which portion is situated on the side of the low pressure chamber (62, 67) becomes relatively large whereby the moment that tries to cause the pushing side member to tilt is reduced.

The present invention provides, as a twelfth aspect according to the tenth aspect, a rotary compressor in which the concave groove (88) of the adjusting mechanism (80) is opened at a portion of the tip surface of the receiving side member which portion is situated nearer the high pressure chamber (61, 66) and the adjusting mechanism (80) includes a communicating path (81) for connection of the concave groove (88) to a space where the suction fluid is present and an on-off valve (82) which is configured such that the communicating path (81) is opened if the difference in pressure between the discharge fluid and the suction fluid falls below a predetermined value while the communicating path (81) is closed if the pressure difference becomes equal to or greater than the predetermined value.

In the twelfth aspect of the present invention, the concave groove (88) is opened at a portion of the tip surface of the receiving side member which portion is situated nearer the high pressure chamber (61, 66). When the difference in pressure between the discharge fluid and the suction fluid becomes equal to or less than the predetermined value, the communicating path (81) is placed in the open state by the on-off valve (82). In this state, the pressure of the suction fluid is introduced through the communicating path (81) into the concave groove (88). If the difference in pressure between the discharge fluid and the suction fluid is relatively small, the internal pressure of the concave groove (88) is set at the same level as the pressure of the suction fluid, to thereby decrease the magnitude of pushing-back force of opposite direction to the pushing force of the pressing mechanism (70). Conversely, if the difference in pressure between the discharge fluid and the suction fluid exceeds the predetermined value, the communicating path (81) is placed in the closed state by the on-off valve (82). In this state, fluid which is being compressed in the high pressure chamber (61, 66) slightly leaks into the concave groove (88), thereby causing the internal pressure of the concave groove (88) to become higher than the pressure of the suction fluid. If the difference in pressure between the discharge fluid and the suction fluid is relatively great, the internal pressure of the concave groove (88) is made higher than the discharge fluid pressure, to thereby increase the magnitude of pushing-back force of opposite direction to the pushing force of the pressing mechanism (70).

As described above, the fluid pressure which is applied to the front surface of the end plate part of the pushing side member which is either the piston (50) or the cylinder (40) is greater on the side of the high pressure chamber (61, 66) than on the side of the low pressure chamber (62, 67). On the other hand, in the present aspect, the concave groove (88) is opened at a portion of the tip surface of the receiving side member which portion is situated nearer the high pressure chamber (61, 66). And, when the pressure of the suction fluid is introduced through the communicating path (81) into the concave groove (88), the pushing-back force which is applied to a portion of the end plate part of the pushing side member which portion is situated on the side of the high pressure chamber (61, 66) becomes relatively small whereby the moment that tries to cause the pushing side member to tilt is reduced.

ADVANTAGEOUS EFFECTS OF THE INVENTION

In the present invention, the pressing mechanism (70) causes application of a pushing force to either the cylinder (40) or the piston (50), whichever serves as a pushing side member. Consequently, even when the pressure of fluid in the cylinder chamber (60, 65) is applied to the end plate part of the cylinder (40) or the piston (50), the clearance between the cylinder (40) and the piston (50) does not expand whereby the leakage of fluid from the high pressure chamber (61, 66) is controlled to thereby improve the efficiency of compression. In addition, in the present invention, the adjusting mechanism (80) adjusts the magnitude of load that is applied to the pushing side member in response to the difference between the discharge pressure and the suction pressure. Consequently, even when there is a change in the operating condition of the rotary compressor (10), it is possible to adequately set the magnitude of load which is applied in the direction towards the end plate part of the receiving side member to the pushing side member, thereby making it possible to reduce loss due to the friction between the pushing side member and the receiving side member. Therefore, in accordance with the present invention, the efficiency of compression of the rotary compressor (10) is enhanced. Besides, the mechanical loss of the rotary compressor (10) during its operation is reduced, thereby improving the performance thereof.

In addition, in accordance with the third to eighth aspects of the present invention, the magnitude of pushing force itself by the pressing mechanism (70) is adjusted by the adjusting mechanism (80), thereby making it possible to accurately adjust the magnitude of load which is applied to the pushing side member. Especially, in accordance with the seventh and eighth aspects of the present invention, even when the operating condition of the rotary compressor (10) is varied to cause a change in the difference in pressure between the discharge fluid and the suction fluid, it is possible to reduce, without fail, the magnitude of moment that tries to cause either the cylinder (40) or the piston (50), whichever serves as a pushing side member, to tilt, thereby making it possible to avoid problems such as a drop in the efficiency of compression, biased wear et cetera due to the tilting of the pushing side member.

In addition, in accordance with the ninth to twelfth aspects of the present invention, the adjusting mechanism (80) adjusts the magnitude of pushing-back force of opposite direction to the pushing force by the pressing mechanism (70), thereby making it possible to accurately adjust the magnitude of load that is applied to the pushing side member. Especially, in accordance with the eleventh and twelfth aspects of the present invention, it is possible to reduce the magnitude of moment that tries to cause the pushing side member to tilt, thereby making it possible to avoid problems such as a drop in the efficiency of compression, biased wear et cetera due to the tilting of the pushing side member.

BRIEF DESCRIPTION OF THE DRAWINGS

In the drawings:

FIG. 3 is a longitudinal cross-sectional view illustrating an essential part of the compression mechanism of the first embodiment, wherein

DETAILED DESCRIPTION OF THE INVENTION

Hereinafter, preferred embodiments of the present invention will be described in detail with reference to the accompanying drawings.

First Embodiment of the Invention

A first embodiment of the present invention is now described. A rotary compressor (10) of the present embodiment is disposed in the refrigerant circuit of a refrigeration apparatus and is used to compress refrigerant.

Figure 1:
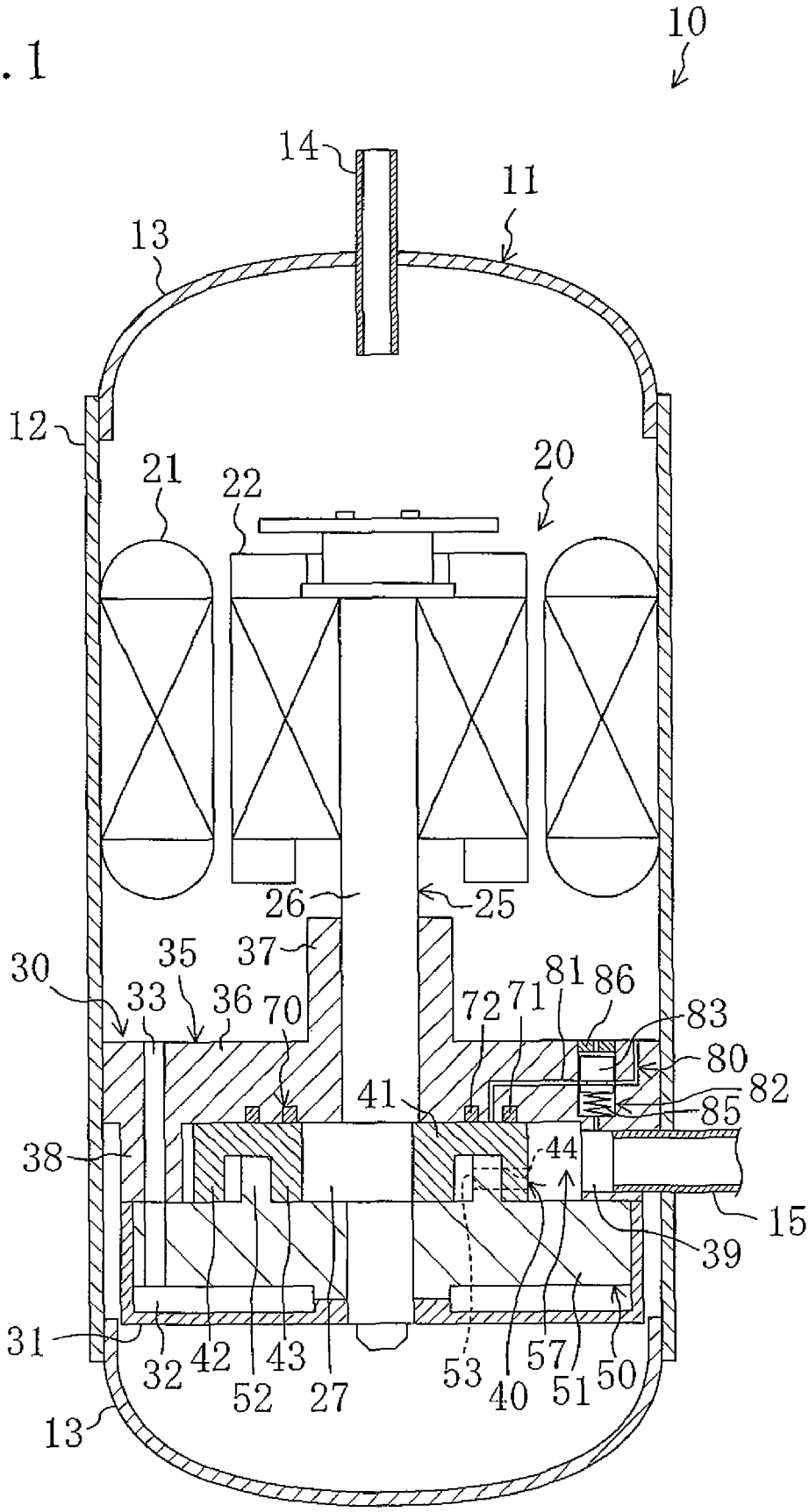
FIG. 1 is a schematic longitudinal cross-sectional view of a rotary compressor according to a first embodiment of the present invention.

As shown in FIG. 1, the rotary compressor (10) of the present embodiment is configured into a so-called hermetic type. The rotary compressor (10) includes a casing (11) which is shaped like a vertically-long, hermetically sealed container. The casing (11) is made up of a circular tube part (12) formed in a vertically-long circular tube shape and a pair of end plates (13) formed in bowl shapes and blocking both ends of the circular tube part (12). The upper end plate (13) is provided with a discharge pipe (14) which passes therethrough. The circular tube part (12) is provided with a suction pipe (15) which passes therethrough.

Disposed in bottom to top order in the casing (11) are a compression mechanism (30) and an electric motor (20). In addition, the casing (11) contains therein a vertically extended crank shaft (25). The compression mechanism (30) and the electric motor (20) are coupled together via the crank shaft (25). The rotary compressor (10) of the present embodiment is of a so-called high pressure dome type. In other words, refrigerant compressed by the compression mechanism (30) is discharged into the internal space of the casing (11) and then fed out therefrom by way of the discharge pipe (14).

The crank shaft (25) includes a main shaft part (26) and an eccentric part (27). The eccentric part (27) is provided at a position nearer the lower end of the crank shaft (25). The eccentric part (27) is shaped like a circular cylinder of greater diameter than that of the main shaft part (26). The axial center of the eccentric part (27) is off-centered from the axial center of the main shaft part (26) by a given amount. An oil feeding path (not shown) is formed within the crank shaft (25). The oil feeding path extends upwardly from the lower end of the crank shaft (25). The lower end of the oil feeding path constitutes a so-called centrifugal pump. Lubricant accumulated on the bottom of the casing (11) is supplied through the oil feeding path to the compression mechanism (30).

The electric motor (20) includes a stator (21) and a rotor (22). The stator (21) is firmly secured to the internal wail of the circular tube part (12) of the casing (11). The rotor (22) is disposed inside the stator (21) and is connected to the main shaft part (26) of the crank shaft (25).

The compression mechanism (30) includes a first housing (35), a second housing (50), and a cylinder (40). In the compression mechanism (30), the first housing (35) and the second housing (50) are superimposed one upon the other and the cylinder (40) is housed in a space enclosed by the first and second housings (35, 50).

The first housing (35) includes a flat plate part (36), a peripheral edge part (38), and a bearing part (37) to constitute a supporting member. The flat plate part (36) is a thick circular plate and its outside diameter is substantially the same as the inside diameter of the casing (11). The flat plate part (36) is firmly secured to the circular tube part (12) of the casing (11) by welding or other suitable means. In addition, the main shaft part (26) of the crank shaft (25) runs through the middle of the flat plate part (36). The peripheral edge part (38) is formed in a short, circular tube shape continuous to the vicinity of the peripheral edge of the flat plate part (36). The peripheral edge part (38) is provided such that it projects downwardly from the front surface of the flat plate part (36) (i.e., the surface on the lower side in FIG. 1). The peripheral edge part (38) is provided with a suction port (39) which runs through the peripheral edge part (38) in the radial direction thereof. The suction pipe (15) is inserted into the suction port (39). The bearing part (37) is formed in a circular tube shape extending along the main shaft part (26). The bearing part (37) is provided such that it projects upwardly from the back surface of the flat plate part (36) (i.e., the surface on the upper side in FIG. 1). The bearing part (37) constitutes a sliding bearing for supporting the main shaft part (26).

The second housing (50) includes an end plate part (51) and a piston main body (52) to constitute a piston. The end plate part (51) is shaped like a thick, circular plate and its outside diameter is slightly smaller than the inside diameter of the casing (11). The end plate part (51) is fastened to the first housing (35) with a bolt or other suitable means. The peripheral edge part (38) of the first housing (35) is in abutment with the front surface of the end plate part (51) (i.e., the surface on the upper side in FIG. 1) In addition, the main shaft part (26)

of the crank shaft (25) runs through the middle of the end plate part (51). The end plate part (51) constitutes a sliding bearing for supporting the main shaft part (26). The piston main body (52) is formed integrally with the end plate part (51) and projects from the front surface of the end plate part (51). The piston main body (52) is formed in a relatively short, circular tube shape with a portion thereof removed and has a C-shape in top plan view. Details of the piston main body (52) will be hereinafter described.

The cylinder (40) includes an end plate part (41), an external cylinder part (42), and an internal cylinder part (43) and is housed in a space defined inside the peripheral edge part (38) of the first housing (35). There is defined between the internal peripheral surface of the peripheral edge part (38) and the external peripheral surface of the cylinder (40) a space. This space is in fluid communication with the suction port (39) and constitutes a suction space (57).

The end plate part (41) is shaped like a thick, flat plate in the form of a doughnut whose radial width is rather wide. The front and the back surface of the end plate part (41) are respectively a lower and an upper surface in FIG. 1.

Figure 2:
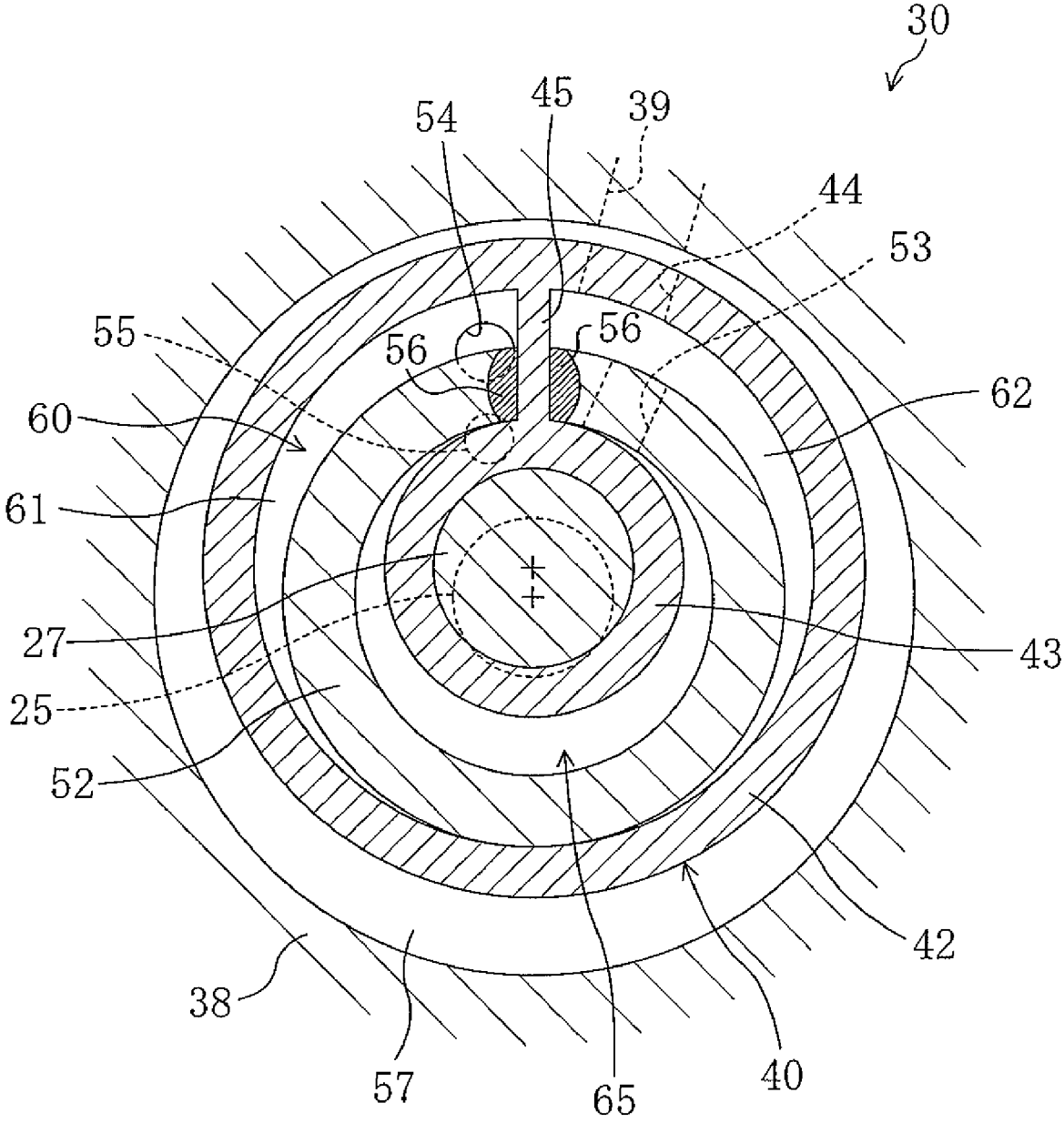
FIG. 2 is a transverse cross-sectional view illustrating an essential part of a compression mechanism of the first embodiment.

As also shown in FIG. 2, the external cylinder part (42) and the internal cylinder part (43) are formed in respective rather thick, relatively short circular tube shapes. The external cylinder part (42) is provided projectingly in an external peripheral portion of the front surface of the end plate part (41) and its external peripheral surface is continuous to the external peripheral surface of the end plate part (41). The internal cylinder part (43) is provided projectingly in an internal peripheral portion of the front surface of the end plate part (41) and its internal peripheral surface is continuous to the internal peripheral surface of the end plate part (41). The inside diameter of the external cylinder part (42) is greater than the outside diameter of the internal cylinder part (43), and a cylinder chamber (60, 65) is defined between the external cylinder part (42) and the internal cylinder part (43). This cylinder chamber (60, 65) has a transverse cross-section (i.e., a cross section orthogonal to the axial direction of the cylinder (40) or a cross section in parallel with the end plate part (41) of the cylinder (40)) of ring shape. The front surface of the end plate part (41) faces the cylinder chamber (60, 65). In addition, both the tip surface of the external cylinder part (42) and the tip surface of the internal cylinder part (43) (the lower end surfaces in FIG. 1) are in sliding contact with the end plate part (51) of the second housing (50).

The eccentric part (27) of the crank shaft (25) runs through the cylinder (40). The external peripheral surface of the eccentric part (27) is in abutment with the internal peripheral surface of the end plate part (41) and with the internal peripheral surface of the internal cylinder part (43). The cylinder (40) which comes into engagement with the eccentric part (27) moves in an eccentric rotation motion with the rotation of the crank shaft (25).

The blade (45) is formed integrally with the cylinder (40). The blade (45) is disposed such that it crosses the cylinder chamber (60, 65) in the radial direction thereof. More specifically, the blade (45) is formed in a flat plate shape extending from the internal peripheral surface of the external cylinder part (42) to the external peripheral surface of the internal cylinder part (43) in the radial direction of the cylinder (40). The blade (45) is integral with the external cylinder part (42) and the internal cylinder part (43). In addition, the blade (45) is in the state of projecting from the front surface of the end plate part (41) and is integral also with the end plate part (41).

As described above, the piston main body (52) is C-shaped in top plan view (see FIG. 2). The outside diameter of the piston main body (52) is smaller than the inside diameter of the external cylinder part (42) and its inside diameter is greater than the outside diameter of the internal cylinder part (43). The piston main body (52) is in the state of being inserted, from below relative to FIG. 1, into the cylinder chamber (60, 65) defined between the external cylinder part (42) and the internal cylinder part (43). The cylinder chamber (60, 65) is divided into a chamber outside the piston main body (52) and a chamber inside the piston main body (52) wherein the outside chamber becomes an external cylinder chamber (60) and the inside chamber becomes an internal cylinder chamber (65).

The piston main body (52) is arranged so that its axial center agrees with the axial center of the main shaft part (26) of the crank shaft (25). The external peripheral surface of the piston main body (52) is in sliding contact, at one point, with the internal peripheral surface of the external cylinder part (42) while its internal peripheral surface is in sliding contact, at one point, with the external peripheral surface of the internal cylinder part (43). The point of sliding contact between the piton main body (52) and the external cylinder part (43) lies on the opposite side across the axial center of the piston main body (52), i.e., at a position deviated 180 degrees in phase relative to the point of sliding contact between the piston main body (52) and the internal cylinder part (43).

In addition, the piston main body (52) is so arranged as to allow the blade (45) to pass through its cutaway portion (see FIG. 2). The external cylinder chamber (60) and the internal cylinder chamber (65) are each divided by the blade (45) into a high pressure chamber (61, 66) and a low pressure chamber (62, 67).

A pair of swinging buses (56) are each inserted into a gap defined between a circumferential end surface of the piston main body (52) and a side surface of the blade (45) (i.e., the surface on the left (right)-hand side in FIG. 2). In other words, one of the pair of swinging bushes (56) is disposed on the left-hand side of the blade (45) and the other on the right-hand side. Each swinging bush (56) is a small piece member the external surface of which is formed in a circular arc shape and the internal surface of which is flat. The circumferential end surfaces of the piston main body (52) are surfaces formed in circular arc shapes and sliding against their associated external surfaces of the swinging bushes (56). In addition, the internal surface of each swinging bush (56) slides against its associated side surface of the blade (45). By the swinging buses (56), the blade (45) is supported rotatably and advanceably/retractably relative to the piston main body (52).

The external cylinder part (42) is provided with a through hole (44). The through hole (44) is formed in the vicinity of the right-hand side of the blade (45) in FIG. 2. The through hole (44) extends through the external cylinder part (42) in the radial direction thereof. The through hole (44) brings the low pressure chamber (62) of the external cylinder chamber (60) into fluid communication with the suction space (57). In addition, the piston main body (52) is provided with a through hole (53). The through hole (53) is formed in the vicinity of the right-hand side of the blade (45) in FIG. 2. The through hole (53) extends through the piston main body (52) in the radial direction thereof. The through hole (53) brings the low pressure chamber (67) of the internal cylinder chamber (65) into fluid communication with the low pressure chamber (62) of the external cylinder chamber (60).

The end plate part (51) of the second housing (50) is provided with an external discharge port (54) and an internal discharge port (55). Both the external discharge port (54) and the internal discharge port (55) extend through the end plate part (51) in the thickness direction thereof. In the front surface of the end plate part (51), the external discharge port (54) is opened at a position nearer the external periphery of the piston main body (52) and adjacent to the left-hand side of the blade (45) in FIG. 2. In addition, the internal discharge port (55) is opened at a position nearer the internal periphery of the piston main body (52) and adjacent to the left-hand side of the blade (45) in FIG. 2. And the external discharge port (54) is in fluid communication with the high pressure chamber (61) of the external cylinder chamber (60) while on the other hand the internal discharge port (55) is in fluid communication with the high pressure chamber (66) of the internal cylinder chamber (65). In addition, the external discharge port (54) and the internal discharge port (55) are opened and closed by their associated discharge valves (not shown).

Mounted to the underside of the second housing (50) is a muffler (31). The muffler (31) is provided such that it covers the second housing (50) from below, and there is defined between the muffler (31) and the second housing (50) a discharge space (32). In addition, formed through external edge parts of the first and second housings (35, 50) is a connecting path (33) for connection of the discharge space (32) to a space defined above the first housing (35).

As shown in FIG. 3, in the compression mechanism (30), a large-diameter seal ring (71) and a small-diameter seal ring (72) are mounted onto the flat plate part (36) of the first housing (35). The large-diameter seal ring (71) and the small-diameter seal ring (72) are fitted into respective concave grooves opened at the front surface of the flat plate part (36) (i.e., the surface on the lower side in FIG. 3). The large-diameter seal ring (71) is disposed such that it encloses the external side of the small-diameter seal ring (72). In addition, the large-diameter seal ring (71) and the small-diameter seal ring (72) are each in abutment with the back surface of the end plate part (41) of the cylinder (40).

Figure 4:
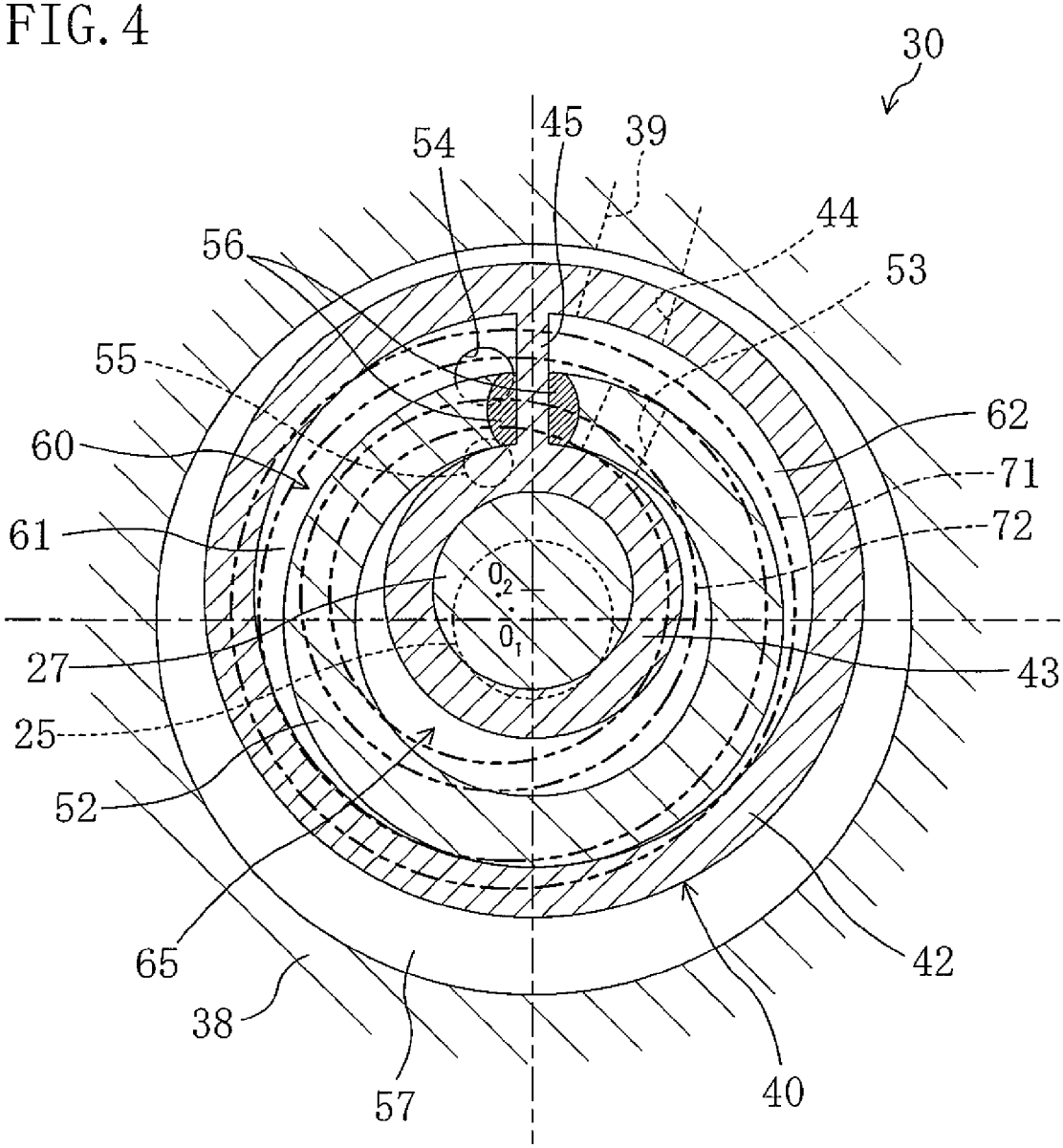
FIG. 4 is a transverse cross-sectional view illustrating an essential part of the compression mechanism of the first embodiment.

In addition, as shown in FIG. 4, the center of the large-diameter seat ring (71) and the center of the small-diameter seal ring (72) are both deviated from the axial center of the piston main body (52) (i.e., the axial center of the main shaft part (26)). The center, $O_1$, of the large-diameter seal ring (71) and the center, $O_2$, of the small-diameter seal ring (72) are both offset nearer the high pressure chamber (61, 66) than the axial center of the piston main body (52). Furthermore, the center of the large-diameter seal ring (71) and the center of the small-diameter seal ring (72) differ from each other in position. The center, $O_2$, of the small-diameter seal ring (72) lies nearer the blade (45) than the center, $O_1$, of the large-diameter seal ring (71).

A very small gap is formed between the front surface of the flat plate part (36) of the first housing (35) and the back surface of the end plate part (41) of the cylinder (40). This gap becomes a back surface side gap (75) (see FIG. 3). The back surface side gap (75) is divided into an internal gap (76) more interior than the small-diameter seal ring (72), an intermediate gap (77) between the small-diameter seal ring (72) and the large-diameter seal ring (71), and an external gap (78) more exterior than the large-diameter seal ring (71).

Since the external gap (78) is in fluid communication with the suction space (57), the internal pressure of the external gap (78) is placed at almost the same level as the pressure of refrigerant which is drawn in to the compression mechanism (30), i.e., the suction pressure. In addition, since the internal gap (76) is filled up with lubricant supplied thereinto through the oil feeding path of the crank shaft (25), the internal pressure of the internal gap (76) is placed at almost the same level as the pressure of refrigerant discharged from the compression mechanism (30), i.e., the discharge pressure. Upon receipt of the internal pressure of the internal gap (76), the cylinder (40) is depressed downwardly relative to FIG. 3. The large-diameter seal ring (71) and the small-diameter seal ring (72) together constitute a pressing mechanism (70) for application of pushing force to the cylinder (40). In addition, in the present embodiment, the cylinder (40) serves as a pushing side member while the second housing (50) as a piston serves as a receiving side member.

As shown in FIG. 3, the compression mechanism (30) is provided with an adjusting mechanism (80). The adjusting mechanism (80) is made up of a communicating path (81) and a differential pressure regulating valve (82) which is an on-off valve. Both the communicating path (81) and the differential pressure regulating valve (82) are provided in the first housing (35).

The communicating path (81) is a path of small diameter formed in the first housing (35). One end of the communicating path (81) opens to the intermediate gap (77) of the back surface side gap (75) while the other end thereof opens at the back surface of the flat plate part (36) of the first housing (35) (i.e., the surface on the upper side in FIG. 3).

The differential pressure regulating valve (82) includes a valve element (83), a spring (85), and a covering member (86). In the flat plate part (36) of the first housing (35), an embedment hole (87) with a bottom extends downwardly from the back surface of the flat plate part (36) across the communicating path (81). The embedment hole (87) contains therein the valve element (83), the spring (85), and the covering member (86). The valve element (83) is formed approximately in a circular cylinder shape and is advanceable/retractable in the axial direction of the embedment hole (87). In addition, an external peripheral groove (84) is formed nearer the lower end of the valve element (83). The external peripheral groove (84) opens at the external peripheral surface of the valve element (83). The spring (85) is disposed between the bottom of the embedment hole (87) and the valve element (83), and the valve element (83) is biased upwardly by the spring (85). A space underlying the valve element (83) in the embedment hole (87) is in fluid communication with the suction port (39). The covering member (86) is disposed such that it closes the upper end of the embedment hole (87). In addition, the covering member (86) is provided with a hole of small diameter. A space overlying the valve element (83) in the embedment hole (87) is in fluid communication through the hole of the covering member (86) with the internal space of the casing (11) filled with discharge gas.

Figure 3A:
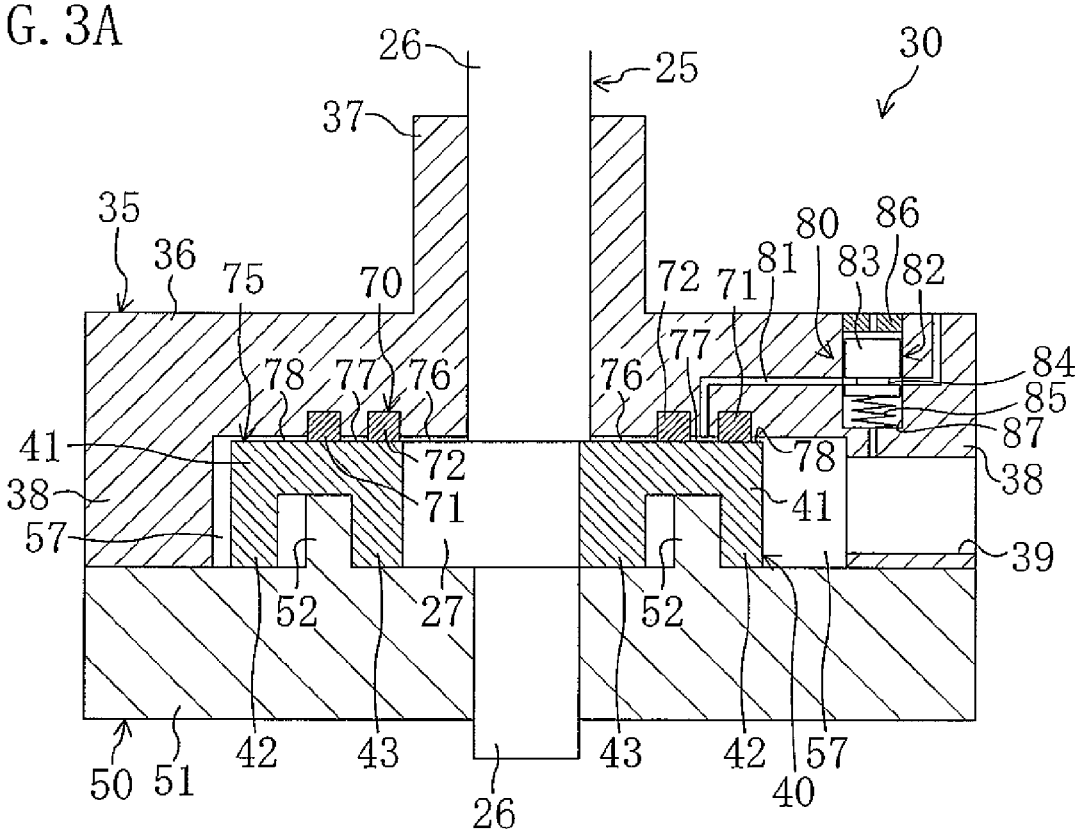
FIG. 3(A) is a diagram showing a state in which the communicating path is placed in the open state and FIG. 3(B) is a diagram showing another state in which the communicating path is placed in the closed state.
Figure 3B:
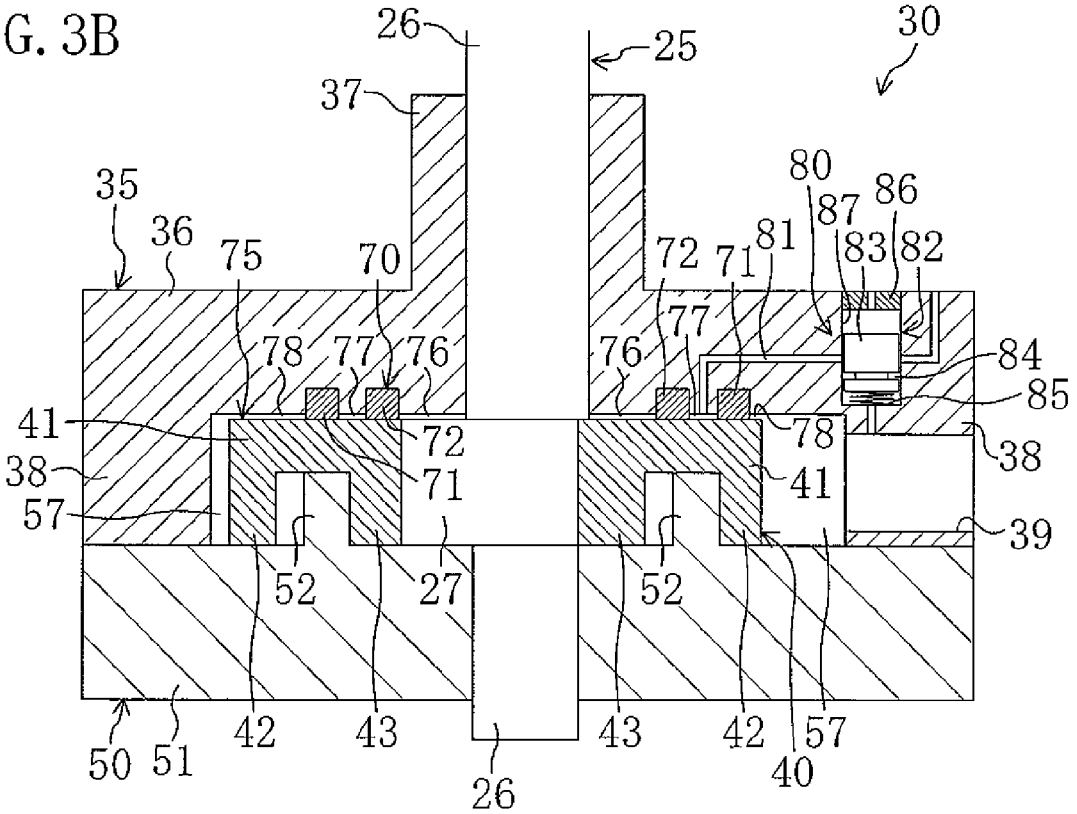

In the valve element (83) of the differential pressure regulating valve (82), the discharge pressure is applied to the upper surface of the valve element (83) while the suction pressure and the bias force of the spring (85) are applied to the lower surface of the valve element (83). The valve element (83) moves vertically in response to the difference between the discharge pressure and the suction pressure. And, as shown in FIG. 3(A), when the level of height of the external peripheral groove (84) of the valve element (83) reaches the position of the communicating path (81), the communicating path (81) is placed in the open state. On the other hand, as shown in FIG. 3(B), when the level of height of the external peripheral groove (84) of the valve element (83) deviates from the position of the communicating path (81), the communicating path (81) is placed in the closed state.

Running Operation

As described above, the rotary compressor (10) is disposed in the refrigerant circuit of a refrigeration apparatus. And, the rotary compressor (10) is configured such that it draws in and compresses refrigerant evaporated in the evaporator and then discharges gas refrigerant compressed to high pressure to the condenser.

Figure 5:
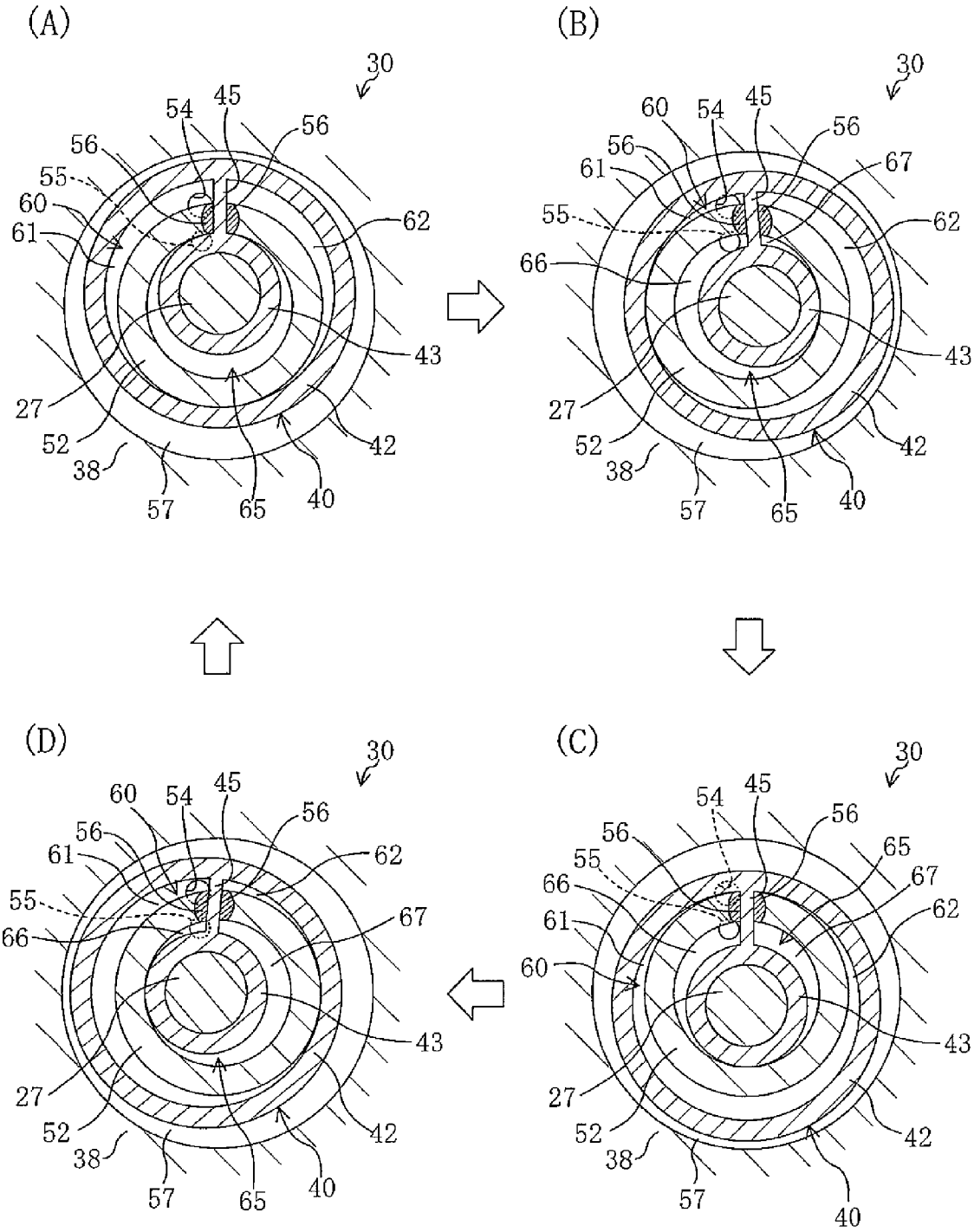
FIG. 5 is a transverse cross-sectional view of the compression mechanism illustrating how the rotary compressor operates.

Here, with reference to FIG. 5, how the rotary compressor (10) compresses refrigerant is described. When the electric motor (20) is energized, the cylinder (40) is driven by the crank shaft (25). The cylinder (40) orbits clockwise in FIG. 5.

In the first place, the process of drawing refrigerant into the internal cylinder chamber (65) for compression thereof is described.

When the cylinder (40) moves slightly from the state of FIG. 5(A), refrigerant starts to be drawn in to the low pressure chamber (67) of the internal cylinder chamber (65). The inflow of refrigerant into the suction port (39) passes in sequence through the suction space (57), then through the through hole (44) of the external cylinder part (42), then through the external cylinder chamber (60), and then through the through hole (53) of the piston main body (52) and enters into the low pressure chamber (67). And, as the cylinder (40) orbits, the volume of the low pressure chamber (67) expands (see FIGS. 5(B), 5(C), 5(D)). When the cylinder (40) returns to the state of FIG. 5(A), the suction of refrigerant into the internal cylinder chamber (65) is over.

When the cylinder (40) rotates to a further extent and the point of sliding contact between the internal cylinder part (43) and the piston main body (52) passes the through hole (53) of the piston main body (52), refrigerant starts to be compressed in the high pressure chamber (66) of the internal cylinder chamber (65). And, as the cylinder (40) orbits, the volume of the high pressure chamber (66) shrinks (see FIGS. 5(B), 5(C), 5(D)), and the refrigerant in the high pressure chamber (66) is compressed. In that process, if the internal pressure of the high pressure chamber (66) increases to some extent, the discharge valve is opened to thereby place the internal discharge port (55) in the open state. Then, the refrigerant in the high pressure chamber (66) is discharged by way of the internal discharge port (55) to the discharge space (32). When the cylinder (40) returns to the state of FIG. 5(A), the discharge of refrigerant from the high pressure chamber (66) is over.

In the second place, the process of drawing refrigerant into the external cylinder chamber (60) for compression thereof is described.

When the cylinder (40) moves slightly from the state of FIG. 5(C), refrigerant starts to be drawn in to the low pressure chamber (62) of the external cylinder chamber (60). The inflow of refrigerant into the suction port (39) passes in sequence through the suction space (57) and then through the through hole (44) of the external cylinder part (42) and enters into the low pressure chamber (62). And, as the cylinder (40) orbits, the volume of the low pressure chamber (62) expands (see FIGS. 5(D), 5(A), 5(B)). When the cylinder (40) returns to the state of FIG. 5(C), the suction of refrigerant into the external cylinder chamber (60) is over.

When the cylinder (40) rotates to a further extent and the point of sliding contact between the external cylinder part (42) and the piston main body (52) passes the through hole (53) of the piston main body (52), refrigerant starts to be compressed in the high pressure chamber (61) of the external cylinder chamber (60). And, as the cylinder (40) orbits, the volume of the high pressure chamber (61) shrinks (see FIGS. 5(D), 5(A), 5(B)), and the refrigerant in the high pressure chamber (61) is compressed. In that process, if the internal pressure of the high pressure chamber (61) increases to some extent, the discharge valve is opened to thereby place the external discharge port (54) in the open state. Then, the refrigerant in the high pressure chamber (61) is discharged by way of the external discharge port (54) to the discharge space (32). When the cylinder (40) returns to the state of FIG. 5(C), the discharge of refrigerant from the high pressure chamber (61) is over.

The refrigerant discharged to the discharge space (32) from the internal and external cylinder chambers (65, 60) flows through the connecting path (33) into the space above the first housing (35) and thereafter is discharged by way of the discharge pipe (14) to outside the casing (11).

As shown in FIG. 3, when the rotary compressor (10) is in operation, the internal gap (76) more interior than the small-diameter seal ring (72) is constantly placed at the same pressure as the discharge pressure while the external gap (78) more exterior than the large-diameter seal ring (71) is constantly placed at the same pressure as the suction pressure. In addition, the pressure of the intermediate gap (77) varies depending on the state of the differential pressure regulating valve (82). The internal pressure of the back surface side gap (75) is applied to the back surface of the end plate part (41) of the cylinder (40) and pushes the cylinder (40) towards the end plate part (51) of the second housing (50) (i.e., in the downward direction in FIG. 3). Consequently, even when the internal pressure of the high pressure chamber (61, 66) increases, the cylinder (40) does not move upwardly, thereby keeping the axial clearance between the cylinder (40) and the second housing (50) constant.

In addition, in the rotary compressor (10), the adjusting mechanism (80) adjusts the magnitude of downward load which is applied to the cylinder (40) in response to the difference between the discharge pressure and the suction pressure. This operation is described with reference to FIG. 3.

In an operating condition as shown in FIG. 3(A) in which the difference between the discharge pressure and the suction pressure is relatively small, the valve element (83) of the differential pressure regulating valve (82) is pushed up by the biasing force of the spring (85), and the communicating path (81) is accordingly placed in the open state. In this state, the internal space of the casing (11) filled up with gas refrigerant discharged from the compression mechanism (30) comes into fluid communication through the communicating path (81) with the intermediate gap (77) and the intermediate gap (77) is placed at the same pressure as the discharge pressure. In other words, in this state, both the internal gap (76) and the intermediate gap (77) are placed at the same pressure as the discharge pressure while only the rest, i.e., the external gap (78), is placed at the same pressure as the suction pressure. Consequently, the area of a portion of the back surface of the cylinder (40) to which portion the discharge pressure is applied expands, and the downward pushing force which is applied to the cylinder (40) is greater as compared to when only the internal gap (76) is placed at the same pressure as the discharge pressure.

In such an operating condition that the difference between the discharge pressure and the suction pressure is relatively small to tend to lack the pushing force which is applied to the cylinder (40), the discharge pressure is introduced into the intermediate gap (77) to thereby ensure the downward load which is applied to the cylinder (40).

On the other hand, in an operating condition as shown in FIG. 3(B) in which the difference between the discharge pressure and the suction pressure is relatively great, the valve element (83) of the differential pressure regulating valve (82) overcomes the biasing force of the spring (85) and is pushed down, and the communicating path (81) is accordingly placed in the closed state. Then, the intermediate gap (77) is made discontinuous from the internal space of the casing (11), and the pressure of the intermediate gap (77) comes to have a value intermediate between the discharge pressure and the suction pressure. That is, since the occurrence of fluid leakage cannot be prevented completely by means of the large- and small-diameter seal rings (71, 72), the pressure of the intermediate gap (77) comes to have a value intermediate between the pressure of the internal gap (76) and the pressure of the external gap (78). Consequently, in the back surface of the cylinder (40), the area of a portion thereof, to which portion the discharge pressure is applied, decreases, and the downward pushing force which is applied to the cylinder (40) becomes smaller as compared to when both the internal gap (76) and the intermediate gap (77) are placed at the same pressure as the discharge pressure.

In such an operating condition that the difference between the discharge pressure and the suction pressure is relatively great to make the pushing force which is applied to the cylinder (40) liable to be excessive, the downward load which is applied to the cylinder (40) is reduced by placing the intermediate gap (77) at a pressure intermediate between the discharge pressure and the suction pressure.

Here, in the rotary compressor (10), the pressure of gas which is applied to the end plate part (41) of the cylinder (40) becomes higher on the side of the high pressure chamber (61, 66) than on the side of the low pressure chamber (62, 67). Consequently, there will still remain a moment that tries to cause the cylinder (40) to tilt if the pushing force is just averagely applied to the back surface of the end plate part (41) of the cylinder (40).

In the rotary compressor (10) of the present embodiment, measurements for reducing such a moment are taken. Stated another way, as described above, in the rotary compressor (10) of the present embodiment, the center position of the large-diameter seal ring (71) and the center position of the small-diameter seal ring (72) are offset nearer the high pressure chamber (61, 66). If the large-diameter seal ring (71) and the small-diameter seal ring (72) are disposed nearer the high pressure chamber (61, 66), the pushing force which is applied to a portion nearer the high pressure chamber (61, 66) becomes greater than the pushing force which is applied a portion nearer the low pressure chamber (62, 67) in the end plate part (41) of the cylinder (40). Consequently, the moment that tries to cause the cylinder (40) to tilt is reduced.

In addition, in the rotary compressor (10), the large-diameter seal ring (71) and the small-diameter seal ring (72) are disposed such their centers lie at different positions. Consequently, the center of application of the pushing force which is applied to the cylinder (40) when only a portion inside the small-diameter seal ring (72) (i.e., the internal gap (76)) is placed at the same pressure as the discharge pressure will differ in position from the center of application of the pushing force which is applied to the cylinder (40) when the entirety of a portion inside the large-diameter seal ring (71) (i.e., both the internal gap (76) and the intermediate gap (77)) is placed at the same pressure as the discharge pressure. In other words, the position of the center of application of the pushing force which is applied to the end plate part (41) of the cylinder (40) varies in response to the difference between the discharge pressure and the suction pressure.

Advantageous Effects of the First Embodiment

In the present embodiment, downward pushing force is applied to the cylinder (40) whereby the cylinder (40) which tries to uplift upon receipt of the pressure of gas in the cylinder chamber (60, 65) is pushed down by the pushing force. Consequently, also during the operation of the rotary compressor (10), the axial clearance between the cylinder (40) and the second housing (50) will not expand and the efficiency of compression is improved by controlling the leakage of fluid from the high pressure chamber (61, 66).

In addition, in the present embodiment, the magnitude of axial load (i.e., the magnitude of vertical load) which is applied to the cylinder (40) as a pushing side member is adjusted by the adjusting mechanism (80) in response to the difference between the discharge pressure and the suction pressure. Consequently, even when the operating condition of the rotary compressor (10) varies, it becomes possible to set the magnitude of axial load which is applied to the cylinder (40) to adequate values. This makes it possible to reduce the loss of power due to the friction between the cylinder (40) and the second housing (50).

Therefore, in accordance with the present embodiment, the efficiency of compression of the rotary compressor (10) is enhanced; the mechanical loss during the operation of the rotary compressor (10) is reduced; and the performance of the rotary compressor (10) is improved.

Furthermore, in accordance with the present embodiment, even when the operating condition of the rotary compressor (10) is varied to cause a change in the difference in pressure between the discharge fluid and the suction fluid, it is still possible to positively reduce the magnitude of moment that tries to cause the cylinder (40) as a pushing side member to tilt, thereby making it possible to avoid problems such as a drop in the efficiency of compression, biased wear et cetera due to the tilting of the cylinder (40).

Second Embodiment of the Invention

A second embodiment of the present invention is described. The rotary compressor (10) of the present embodiment is a modification of the rotary compressor (10) of the first embodiment in that the adjusting mechanism (80) and the pressing mechanism (70) are modified in configuration. Here, the difference from the first embodiment in regard to the rotary compressor (10) of the present embodiment is explained.

Figure 6:
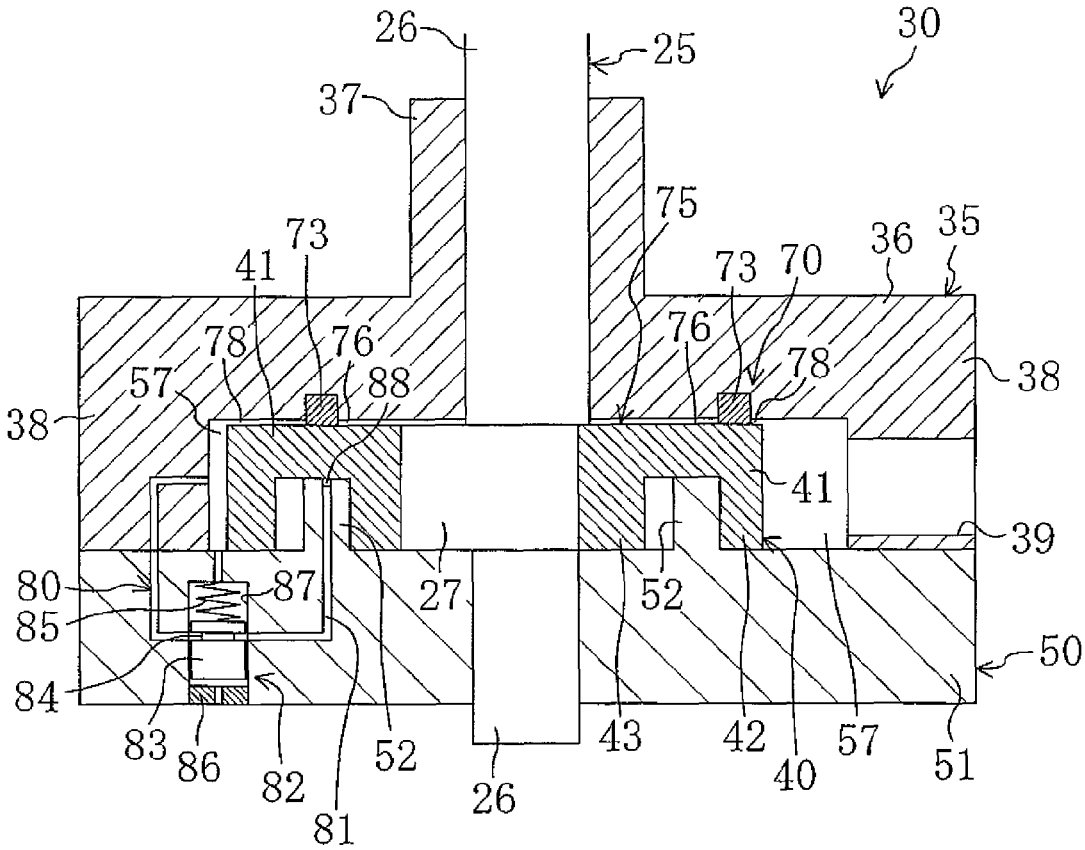
FIG. 6 is a longitudinal cross-sectional view illustrating an essential part of a compression mechanism according to a second embodiment of the present invention.

As shown in FIG. 6, the adjusting mechanism (80) of the present embodiment includes a communicating path (81) and a differential pressure regulating valve (82). In addition, the differential pressure regulating valve (82) of the present embodiment includes a valve element (83), a spring (85), and a covering member (86). In regard to these components, the adjusting mechanism (80) of the present embodiment is the same as the first embodiment. However, the adjusting mechanism (80) of the present embodiment differs in how the communicating path (81) and the differential pressure regulating valve (82) are arranged from its counterpart of the first embodiment. In addition, the adjusting mechanism (80) farther includes, in addition to the communicating path (81) and the differential pressure regulating valve (82), a concave groove (88).

Figure 7:
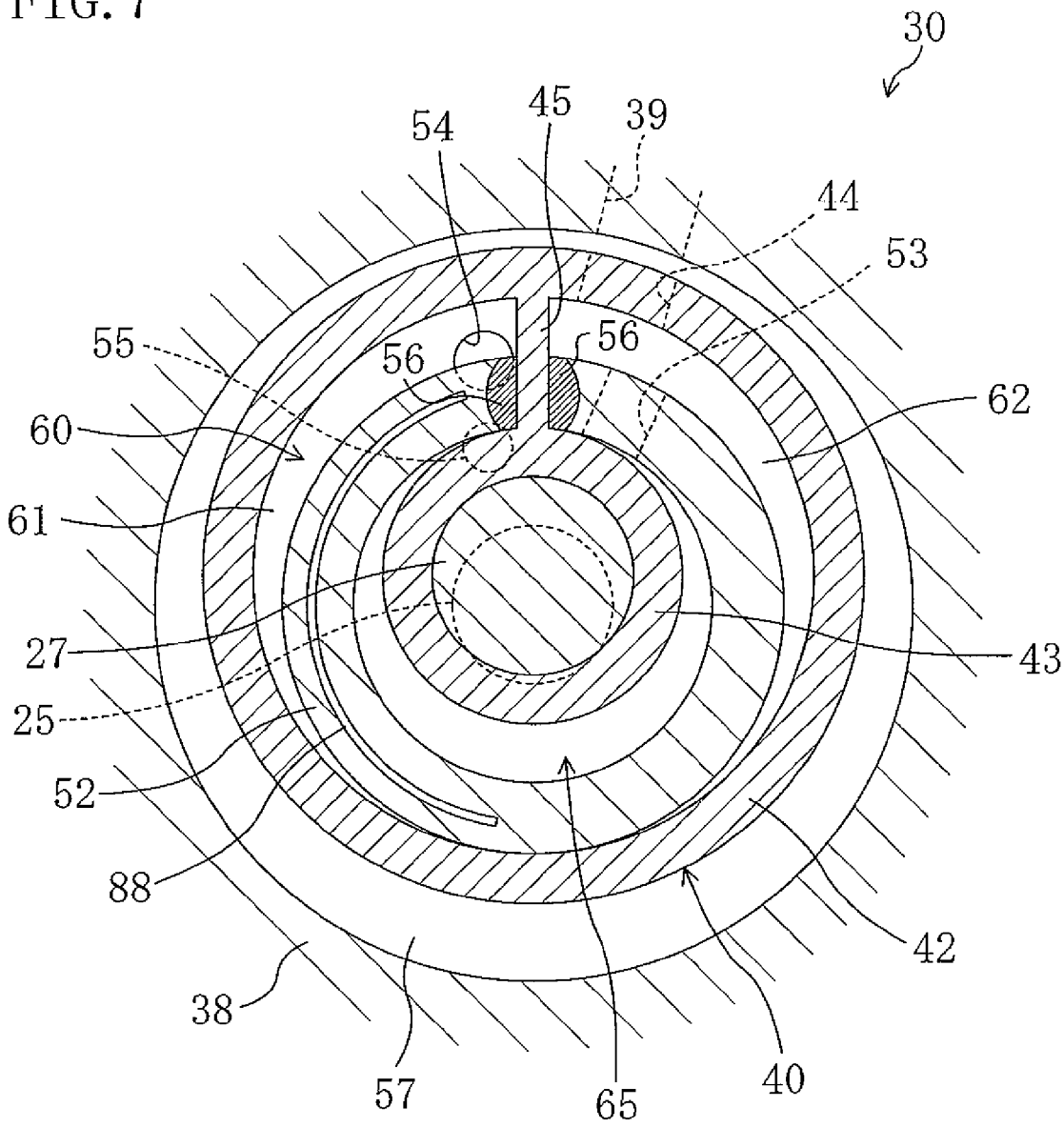
FIG. 7 is a transverse cross-sectional view illustrating an essential part of the compression mechanism of the second embodiment.

The concave groove (88) of the adjusting mechanism (80) is formed in the piston main body (52) in the second housing (50). More specifically, the concave groove (88) is formed in a portion of the piston main body (52) (i.e., substantially the left-hand half in FIG. 7) which portion is situated nearer the high pressure chamber (61, 66). The concave groove (88) is an elongated groove which opens at the tip surface of the piston main body (52) (i.e., the upper end surface in FIG. 7) and extends in a circular arc shape along the direction in which the piston main body (52) extends. In this way, the concave groove (88) opens at a surface of the piston main body (52) which surface slides against the end plate part (41) of the cylinder (40).

The communicating path (81) of the adjusting mechanism (80) is formed such that it extends between the peripheral edge part (38) of the first housing (35) and the second housing (50). One end of the communicating path (81) opens at the internal peripheral surface of the peripheral edge part (38) and the communicating path (81) is in fluid communication, at the side of the one end thereof, with the suction space (57). In addition, the other end of the communicating path (81) opens at the bottom surface of the concave groove (88) formed in the piston main body (52). In other words, the communicating path (81) connects the concave groove (88) to the suction space (57).

The differential pressure regulating valve (82) of the adjusting mechanism (80) made up of the valve element (83), the spring (85), and the covering member (86) is embedded in the second housing (50). More specifically, in the end plate part (51) of the second housing (50), an embedment hole (87) having a bottom and extending upwardly from the back surface thereof is formed such that it crosses the communicating path (81), and the valve element (83), the spring (85), and the covering member (86) are contained in the embedment hole (87). The valve element (83) is formed substantially in a circular cylinder shape and is advanceable/retractable in the axial direction of the embedment hole (87). In addition, an external peripheral groove (84) is formed nearer the upper end of the valve element (83). The external peripheral groove (84) opens at the external peripheral surface of the valve element (83). The spring (85) is disposed between the bottom of the embedment hole (87) and the valve element (83). The valve element (83) is biased downwardly by the spring (85). In the embedment hole (87), a space thereof overlying the valve element (83) is in fluid communication with the suction space (57). The covering member (86) is mounted such that it covers the lower end of the embedment hole (87). In addition, the covering member (86) is provided with a hole of small diameter. In the embedment hole (87), a space thereof underlying the valve element (83) is in fluid communication through the hole of the covering member (86) with the discharge space (32) filled up with discharge gas.

In the valve element (83) of the differential pressure regulating valve (82), the discharge pressure is applied to the lower surface while the suction pressure and the biasing force of the spring (85) are applied to the upper surface. The valve element (83) vertically moves in response to the difference between the discharge pressure and the suction pressure. And, when the level of height of the external peripheral groove (84) of the valve element (83) falls down to the position of the communicating path (81), the communicating path (81) is placed in the open state. In addition, when the level of height of the external peripheral groove (84) of the valve element (83) deviates from the position of the communicating path (81), the communicating path (81) is placed in the closed state. Also note that the state as shown in FIG. 6 is that the valve element (83) places the communicating path (81) in the open state.

In the rotary compressor (10) of the present embodiment, the compression mechanism (30) is provided with a single seal ring (73). This single seal ring (73) constitutes a pressing mechanism (70). Like the large-diameter seal ring (71) and the small-diameter seal ring (72) in the first embodiment, the seal ring (73) is fitted into a concave groove which opens at the lower surface of the flat plate part (36) of the first housing (35). The seal ring (73) is in abutment with the back surface of the end plate part (41) of the cylinder (40). And, the seal ring (73) divides the back surface side gap (75) defined between the flat plate part (36) of the first housing (35) and the end plate part (41) of the cylinder (40) into an internal gap (76) inside the seal ring (73) and an external gap (78) outside the seal ring (73). During the operation of the rotary compressor (10), the internal pressure of the internal gap (76) is maintained at the same level as the discharge pressure while the internal pressure of the external gap (78) is maintained at the same level as the suction pressure.

Running Operation

The adjusting mechanism (80) of the present embodiment adjusts the magnitude of downward load which is applied to the cylinder (40) in response to the difference between the discharge pressure and the suction pressure. At that time, the adjusting mechanism (80) varies the magnitude of pushing-back force which is upwardly applied to the cylinder (40) to thereby cause the magnitude of downward load which is applied to the cylinder (40) to vary.

In the first place, in an operating condition in which the difference between the discharge pressure and the suction pressure is relatively small, the valve element (83) of the differential pressure regulating valve (82) is pushed down by the biasing force of the spring (85) whereby the communicating path (81) is placed in the open state. In this state, the concave groove (88) and the suction space (57) fluidly communicate with each other through the communicating path (81) and the pressure of the concave groove (88) is placed at the same level as the suction pressure. In other words, in this state, not the pressure of fluid in the high pressure chamber (61, 66) but the suction pressure is applied to a portion of the front surface of the end plate part (41) of the cylinder (40) which portion faces the concave groove (88). Consequently, the magnitude of pushing-back force which upwardly pushes the cylinder (40) becomes decreased while the magnitude of downward load which is applied to the cylinder (40) becomes increased.

In such an operating condition that the difference between the discharge pressure and the suction pressure is relatively small to tend to lack the pushing force which is applied to the cylinder (40), the suction pressure is introduced into the concave groove (88) to thereby reduce the magnitude of upward pushing-back force which is applied to the cylinder (40), and the downward load which is applied to the cylinder (40) is ensured.

On the other hand, in an operating condition in which the difference between the discharge pressure and the suction pressure is relatively great, the valve element (83) of the differential pressure regulating valve (82) overcomes the biasing force of the spring (85) and is pushed up whereby the communicating path (81) is placed in the closed state. In this state, the concave groove (88) is made discontinuous from the suction space (57) and the fluid in the high pressure chamber (61, 66) gradually leaks into the concave groove (88). And, the pressure of the concave groove (88) becomes higher as compared to when the communicating path (81) is placed in the open state. Consequently, the magnitude of pushing-back force which tries to push up the cylinder (40) increases, and the downward load which is applied to the cylinder (40) decreases.

In such an operating condition in which the difference between the discharge pressure and the suction pressure is relatively great to make the pushing force which is applied to the cylinder (40) liable to be excessive, the pressure of the concave groove (88) is made higher than the suction pressure to thereby increase the upward load which is applied to the cylinder (40) whereby the downward load which is applied to the cylinder (40) is reduced.

In the compression mechanism (30) of the present embodiment, the fluid pressure which is applied to the front surface of the end plate part (41) of the cylinder (40) is higher on the side of the high pressure chamber (61, 66) than on the side of the low pressure chamber (62, 67). To cope with this, in the present embodiment, the concave groove (88) is opened at a portion of the tip surface of the piston main body (52) which portion is situated nearer the high pressure chamber (61, 66). And, when the suction pressure is introduced through the communicating path (81) into the concave groove (88), the pushing-back force which is applied to a portion of the end plate part (41) of the cylinder (40) which portion is situated on the side of the high pressure chamber (61, 66) becomes relatively small, and the moment that tries to cause the cylinder (40) to tilt is reduced.

Advantageous Effects of the Second Embodiment

In the present embodiment, the adjusting mechanism (80) adjusts the magnitude of pushing-back force which is upwardly applied to the cylinder (40). Consequently, as in the first embodiment, it is possible to accurately adjust the magnitude of downward load which is applied to the cylinder (40).

In addition, in the present embodiment, the concave groove (88) is opened at a portion of the tip surface of the piston main body (52) which portion is situated nearer the high pressure chamber (61, 66). As a result of this arrangement, the moment that tries to cause the cylinder (40) to tilt is reduced, thereby making it possible to avoid problems such as a drop in compression efficiency, biased wear et cetera due to the tilting of the cylinder (40).

Third Embodiment of the Invention

A third embodiment of the present invention is described. The rotary compressor (10) of the present embodiment is a modification of the rotary compressor (10) of the second embodiment in that the adjusting mechanism (80) is modified in configuration. Here, the adjusting mechanism (80) of the present embodiment is described with reference to FIGS. 8 and 9.

In the adjusting mechanism (80) of the present embodiment, the concave groove (88) is formed in the piston main body (52) of the second housing (50). The concave groove (88) is formed in a portion of the piston main body (52) (i.e., substantially the right-hand half in FIG. 9) which portion is situated nearer the low pressure chamber (62, 67). The concave groove (88) is an elongated groove which opens at the tip surface of the piston main body (52) (i.e., the upper end surface in FIG. 8) and extends in a circular arc shape along the direction in which the piston main body (52) extends. In this way, the concave groove (88) opens at a surface of the piston main body (52) which surface slides against the end plate part (41) of the cylinder (40).

The communicating path (81) of the adjusting mechanism (80) is formed in the second housing (50). One end of the communicating path (81) opens at the back surface of the end plate part (51) of the second housing (50) (i.e., the lower surface in FIG. 8) and the communicating path (81) is in fluid communication, at the side of the one end thereof with the discharge space (32). In addition, the other end of the communicating path (81) opens at the bottom surface of the concave groove (88) formed in the piston main body (52). In other words, the communicating path (81) connects the concave groove (88) to the discharge space (32).

The differential pressure regulating valve (82) of the adjusting mechanism (80) made up of the valve element (83), the spring (85), and the covering member (86) is embedded in the second housing (50). More specifically, in the end plate part (51) of the second housing (50), an embedment hole (87) having a bottom and extending upwardly from the back surface thereof is formed such that it crosses the communicating path (81), and the valve element (83), the spring (85), and the covering member (86) are contained in the embedment hole (87). The valve element (83) is formed substantially in a circular cylinder shape and is advanceable/retractable in the axial direction of the embedment hole (87). In addition, an external peripheral groove (84) is formed nearer the upper end of the valve element (83). The external peripheral groove (84) opens at the external peripheral surface of the valve element (83). The spring (85) is disposed between the bottom of the embedment hole (87) and the valve element (83). The valve element (83) is biased downwardly by the spring (85). In the embedment hole (87), a space thereof overlying the valve element (83) is in fluid communication with the suction port (39). The covering member (86) is mounted such that it covers the lower end of the embedment hole (87). In addition, the covering member (86) is provided with a hole of small diameter. In the embedment hole (87), a space thereof underlying the valve element (83) is in fluid communication through the hole of the covering member (86) with the discharge space (32) filled up with discharge gas.

Figure 8:
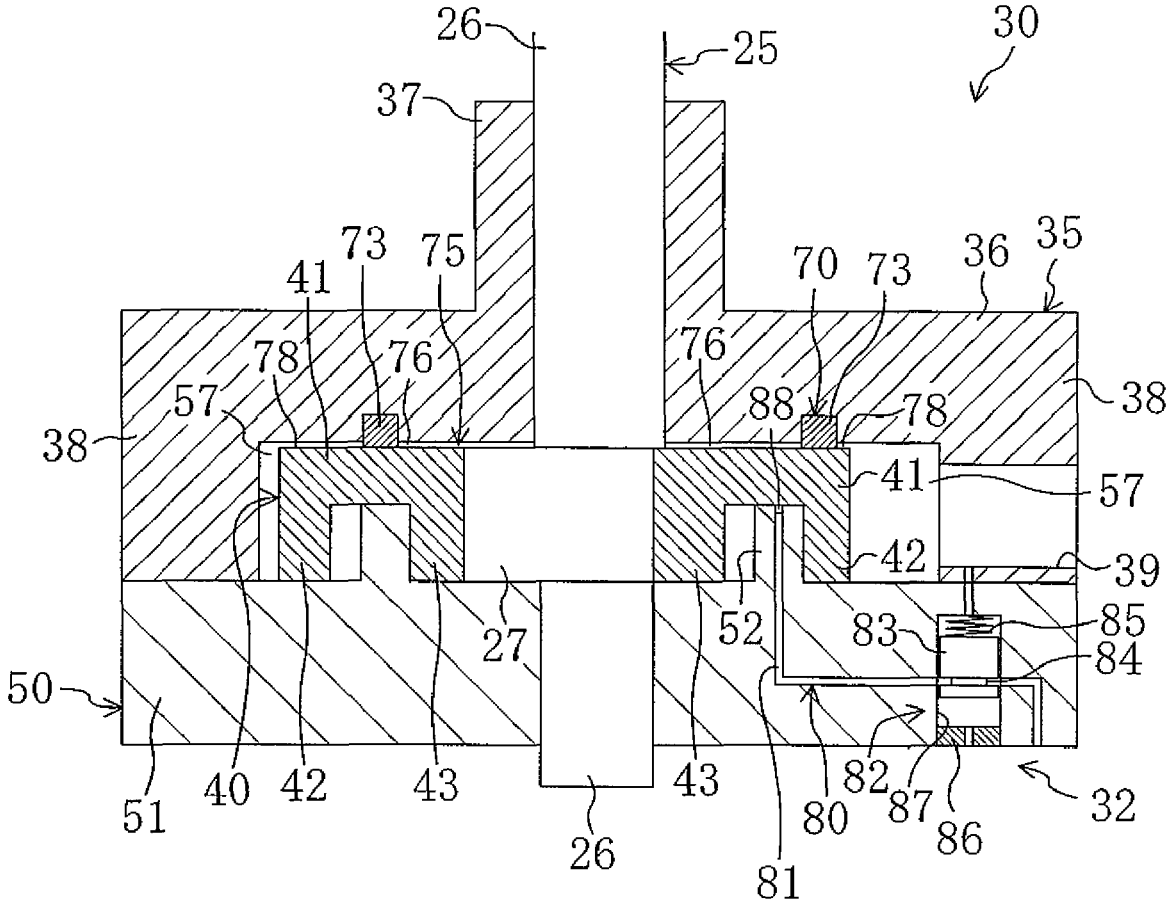
FIG. 8 is a longitudinal cross-sectional view illustrating an essential part of a compression mechanism according to a third embodiment of the present invention.
Figure 9:
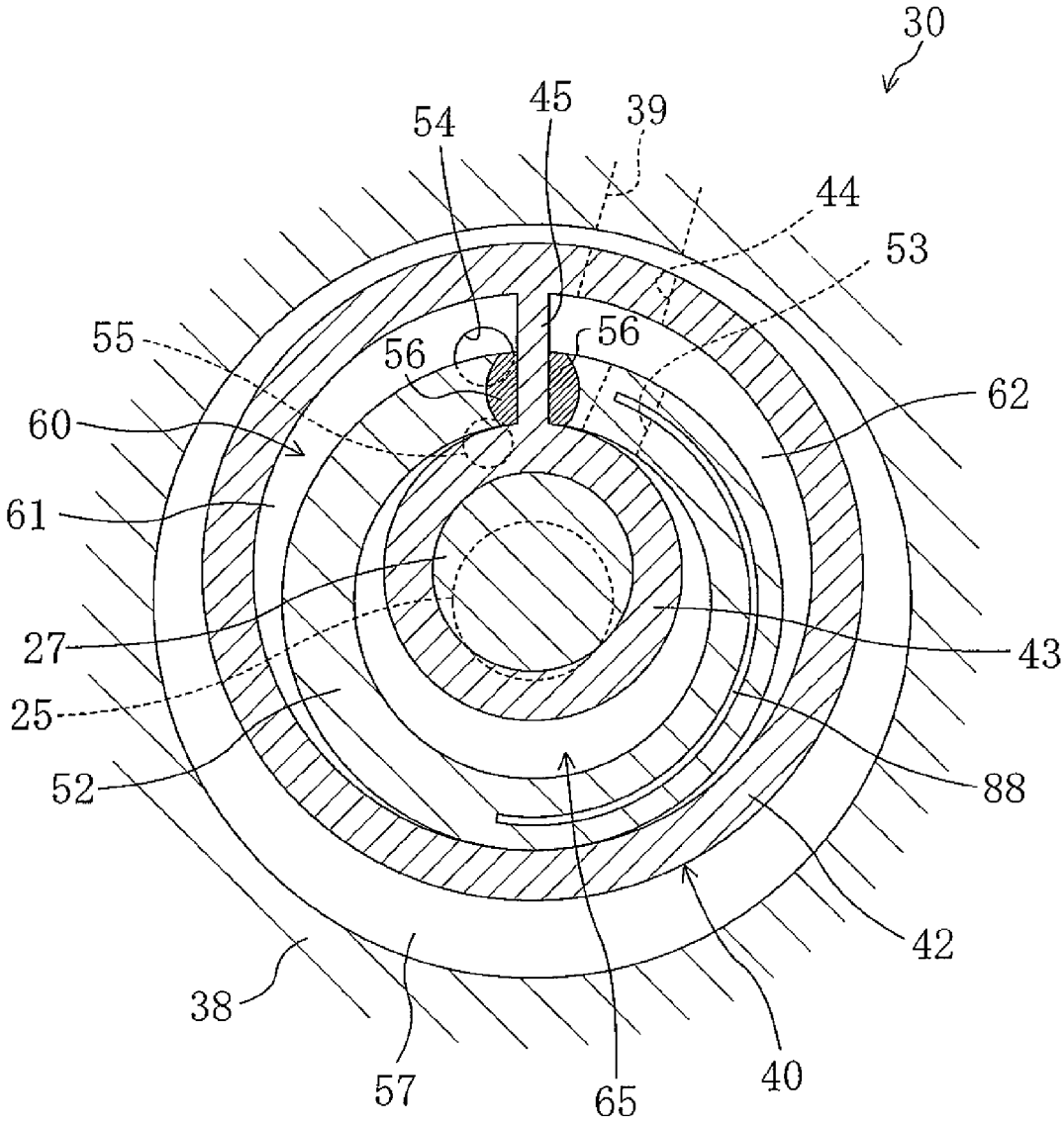
FIG. 9 is a transverse cross-sectional view illustrating an essential part of the compression mechanism of the third embodiment.

In the valve element (83) of the differential pressure regulating valve (82), the discharge pressure is applied to the lower surface while the suction pressure and the biasing force of the spring (85) are applied to the upper surface. The valve element (83) vertically moves in response to the difference between the discharge pressure and the suction pressure. And, when the level of height of the external peripheral groove (84) of the valve element (83) falls down to the position of the communicating path (81), the communicating path (81) is placed in the open state. In addition, when the level of height of the external peripheral groove (84) of the valve element (83) deviates from the position of the communicating path (81), the communicating path (81) is placed in the closed state. Also note that the state as shown in FIG. 8 is that the valve element (83) places the communicating path (81) in the open state.

Running Operation

The adjusting mechanism (80) of the present embodiment varies the magnitude of pushing-back force which is upwardly applied to the cylinder (40) to thereby cause the magnitude of downward load which is applied to the cylinder (40) to vary, as in the second embodiment.

In the first place, in an operating condition in which the difference between the discharge pressure and the suction pressure is relatively great, the valve element (83) of the differential pressure regulating valve (82) overcomes the biasing force of the spring (85) and is pushed up whereby the communicating path (81) is placed in the open state. In this state, the concave groove (88) and the discharge space (32) are brought into fluid communication with each other, and the pressure of the concave groove (88) is placed at the same level as the discharge pressure. In other words, in this state, not the pressure of fluid in the low pressure chamber (62, 67) but the discharge pressure is applied to a portion of the front surface of the end plate part (41) of the cylinder (40) which portion faces the concave groove (88). Consequently, the magnitude of pushing-back force which tries to push up the cylinder (40) increases, and the magnitude of downward load which is applied to the cylinder (40) decreases.

In such an operating condition in which the difference between the discharge pressure and the suction pressure is relatively great to make the pushing force which is applied to the cylinder (40) liable to be excessive, the pressure of the concave groove (88) is placed at the same level as the discharge pressure to thereby increase the upward load which is applied to the cylinder (40) whereby the downward load which is applied to the cylinder (40) is reduced.

On the other hand, in an operating condition in which the difference between the discharge pressure and the suction pressure is relatively small, the valve element (83) of the differential pressure regulating valve (82) is pushed down by the biasing force of the spring (85) whereby the communicating path (81) is placed in the closed state. In this state, the concave groove (88) is made discontinuous from the discharge space (32), and gas refrigerant in the concave groove (88) gradually leaks into the low pressure chamber (62, 67). And, the pressure of the concave groove (88) becomes lower as compared to when the communicating path (81) is placed in the open state. Consequently, the magnitude of pushing-back force which tries to push up the cylinder (40) decreases, and the downward load which is applied to the cylinder (40) increases.

In such an operating condition in which the difference between the discharge pressure and the suction pressure is relatively small to tend to lack the pushing force which is applied to the cylinder (40), the internal pressure of the concave groove (88) is made lower than the discharge pressure to thereby reduce the magnitude of upward pushing-back force which is applied to the cylinder (40), and the downward load which is applied to the cylinder (40) is ensured.

In the compression mechanism (30) of the present embodiment, the fluid pressure which is applied to the front surface of the end plate part (41) of the cylinder (40) is lower on the side of the low pressure chamber (62, 67) than on the side of the high pressure chamber (61, 66). To cope with this, in the present embodiment, the concave groove (88) is opened at a portion of the tip surface of the piston main body (52) which portion is situated nearer the low pressure chamber (62, 67). And, when the discharge pressure is introduced through the communicating path (81) into the concave groove (88), the pushing-back force which is applied to a portion of the end plate part (41) of the cylinder (40) which portion is situated on the side of the low pressure chamber (62, 67) becomes relatively great, and the moment that tries to cause the cylinder (40) to tilt is reduced.

Another Embodiment

First Variation

Figure 10:
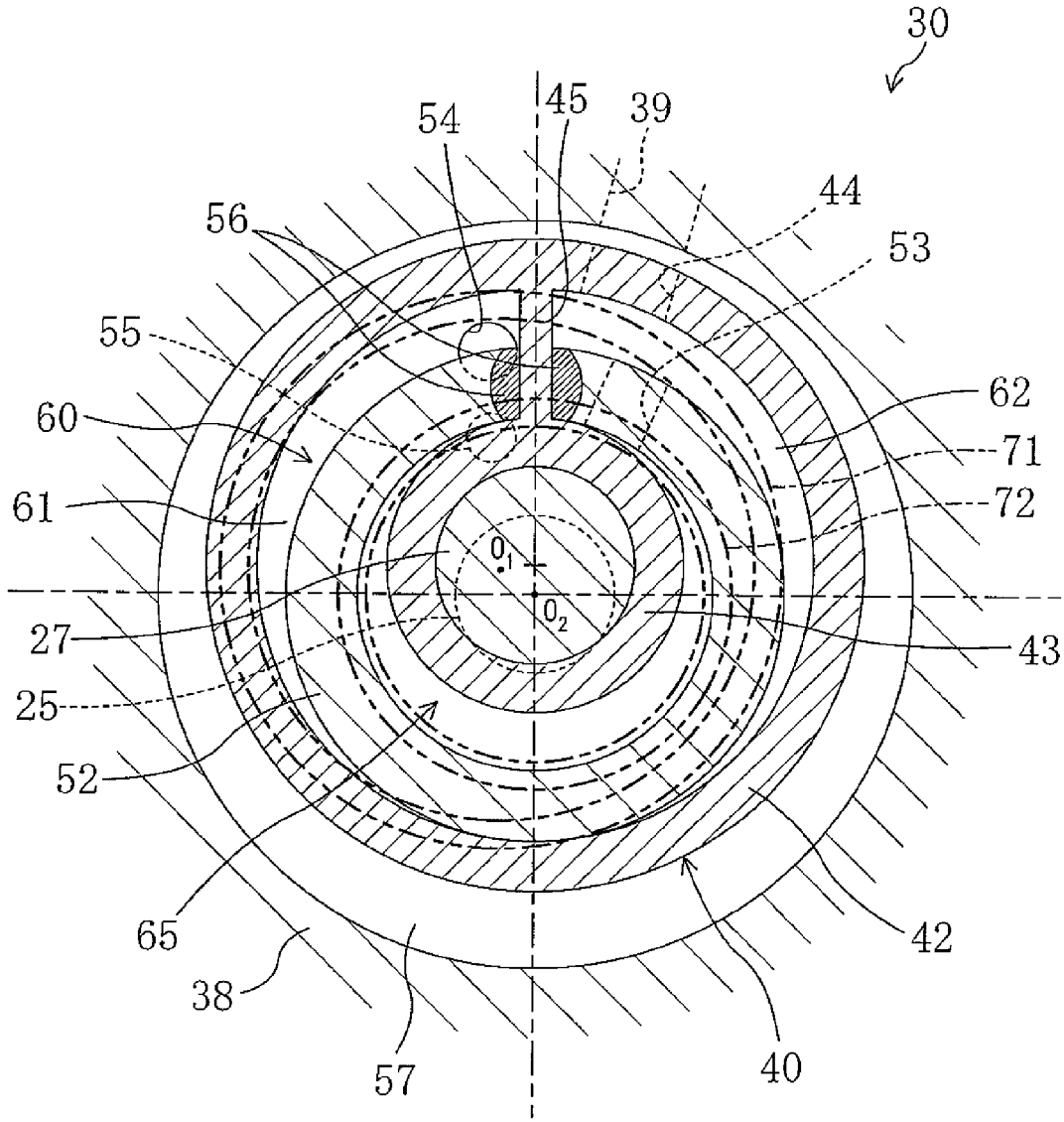
FIG. 10 is a transverse cross-sectional view illustrating an essential part of a compression mechanism according to a first variation of another embodiment of the present invention.

In the compression mechanism (30) of the first embodiment, both the center of the large-diameter seal ring (71) and the center of the small-diameter seal ring (72) are offset from the axial center of the main shaft part (26). Alternatively, it may be arranged such that as shown in FIG. 10, only the center, $O_1$, of the large-diameter seal ring (71) is offset from the axial center of the main shaft part (26) while the center, $O_2$, of the small-diameter seal ring (72) is made coaxial with the main shaft part (26).

If the large-diameter seal ring (71) and the small-diameter seal ring (72) are arranged in the way as described above, the area of a portion of the intermediate gap (77) defined between the large-diameter seal ring (71) and the small-diameter seal ring (72) which portion is situated nearer the high pressure chamber (61, 66) will expand. And, in the end plate part (41) of the cylinder (40), the point of application of the force applied by the internal pressure of the intermediate gap (77) (i.e., the pushing force) comes to lie nearer the high pressure chamber (61, 66), as a result of which it becomes possible to reduce, without fail, the moment that tries to cause the cylinder (40) to tilt with less pushing force. Therefore, in accordance with the present variation, it is possible to reduce the sliding loss due to the pushing force which is applied to the cylinder (40) while controlling the tilting of the cylinder (40).

Second Variation

The compression mechanism (80) of the first embodiment may be configured such that a portion of the back surface side gap (75) which portion is situated more exterior than the large-diameter seal ring (71) (i.e., the external gap (78)) is placed at the same pressure as the discharge pressure. Here, the difference of the present variation from the first embodiment is described.

Figure 11:
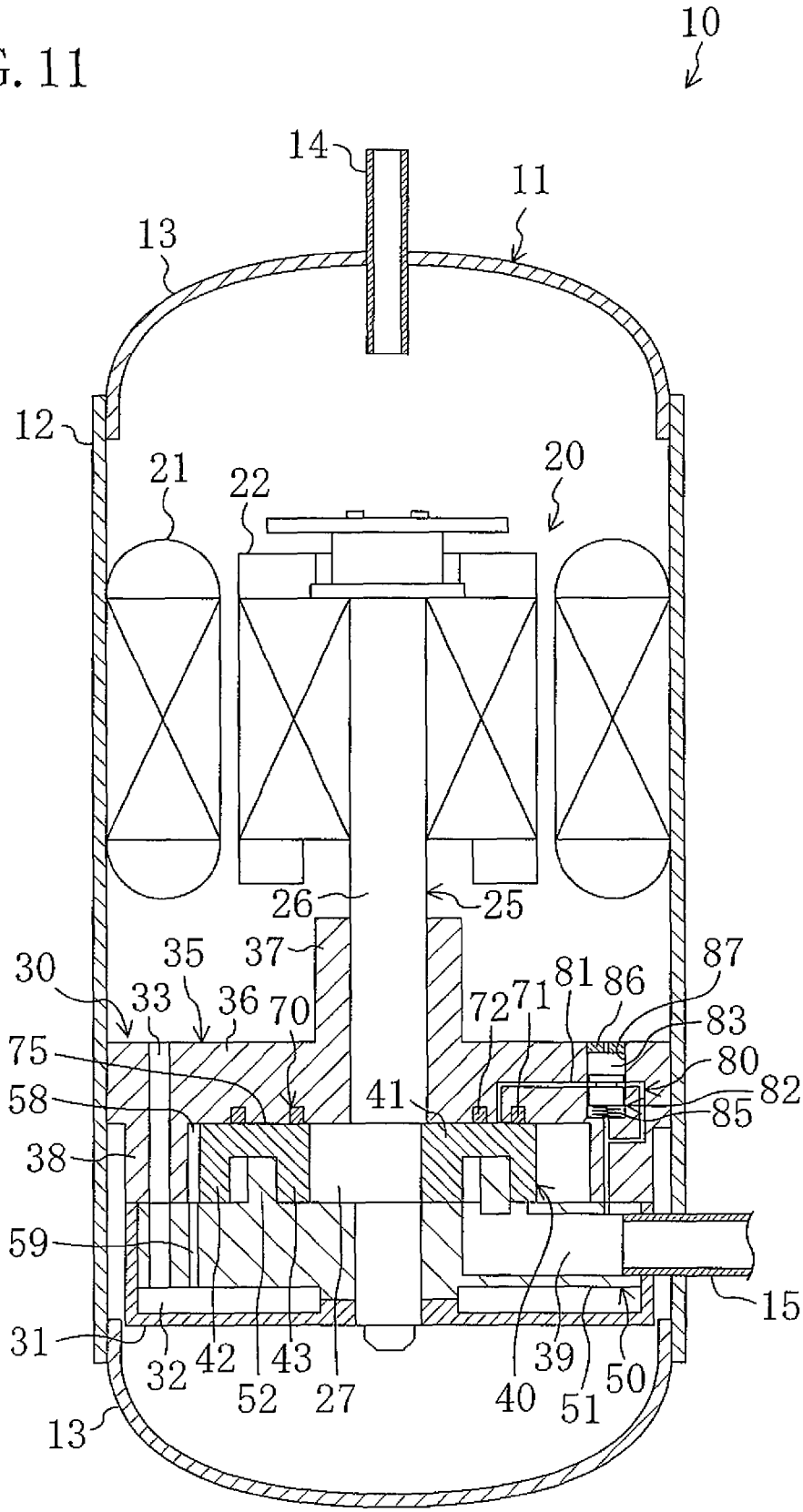
FIG. 11 is a schematic longitudinal cross-sectional view of a rotary compressor according to a second variation of the other embodiment.

As shown in FIG. 11, in the compression mechanism (30) of the present variation, the suction port (39) is formed in the second housing (50). The terminal end of the suction port (39) is opened at the upper surface of the second housing (50) on both the internal and external peripheral sides of the piston main body (52).

In the compression mechanism (30), the second housing (50) is provided with a discharge pressure introducing path (59). The discharge pressure introducing path (59) brings a space defined between the internal peripheral surface of the peripheral edge part (38) of the first housing (35) and the external peripheral surface of the cylinder (40) into fluid communication with the discharge space (32). And, the space between the peripheral edge part (38) of the first housing (35) and the cylinder (40) is placed at an internal pressure of the same level as the discharge pressure and constitutes a discharge pressure space (58).

In the compression mechanism (30), the communicating path (81) is formed such that it extends from the second housing (50) to the first housing (35). One end of the communicating path (81) is connected to a portion of the back surface side gap (75) which portion is situated between the large-diameter seal ring (71) and the small-diameter seal ring (72) (i.e., the intermediate gap (77)) while the other end thereof is connected to the suction port (39). In addition, in the differential pressure regulating valve (82) of the present variation, a space underlying the valve element (83) in the embedment hole (87) is connected through the communicating path (81) to the suction port (39).

In an operating condition in which the difference between the discharge pressure and the suction pressure is relatively great, the valve element (83) of the differential pressure regulating valve (82) overcomes the biasing force of the spring (85) and is pushed down whereby the communicating path (81) is placed in the open state (see FIG. 11). In this state, the suction port (39) is brought into fluid communication through the communicating path (81) with the intermediate gap (77), and the pressure of the intermediate gap (77) is placed at the same level as the suction pressure. Consequently, the area of a portion of the back surface of the cylinder (40) to which portion the discharge pressure is applied is reduced, and the downward load which is applied to the cylinder (40) becomes smaller as compared to when both the internal gap (76) and the intermediate gap (77) are placed at the same pressure as the discharge pressure.

In such an operating condition in which the difference between the discharge pressure and the suction pressure is relatively great to make the pushing force which is applied to the cylinder (40) liable to be excessive, the pressure of the intermediate gap (77) is placed at the same level as the suction pressure to thereby reduce the downward load which is applied to the cylinder (40).

On the other hand, in an operating condition in which the difference between the discharge pressure and the suction pressure is relatively small, the valve element (83) of the differential pressure regulating valve (82) is pushed up by the biasing force of the spring (85) whereby the communicating path (81) is placed in the closed state. And, the intermediate gap (77) is made discontinuous from the suction port (39), and the pressure of the intermediate gap (77) gradually increases to be finally placed at the same pressure as the discharge pressure. In other words, since the occurrence of fluid leakage cannot be prevented completely by means of the large- and small-diameter seal rings (71, 72), the pressure of the intermediate gap (77) becomes equal to the pressure of the internal gap (76) and to the pressure of the external gap (78).

In such an operating condition in which the difference between the discharge pressure and the suction pressure is relatively small to tend to lack the pushing force which is applied to the cylinder (40), the pressure of the intermediate gap (77) is increased to thereby ensure the downward load which is applied to the cylinder (40).

Third Variation

Figure 12:
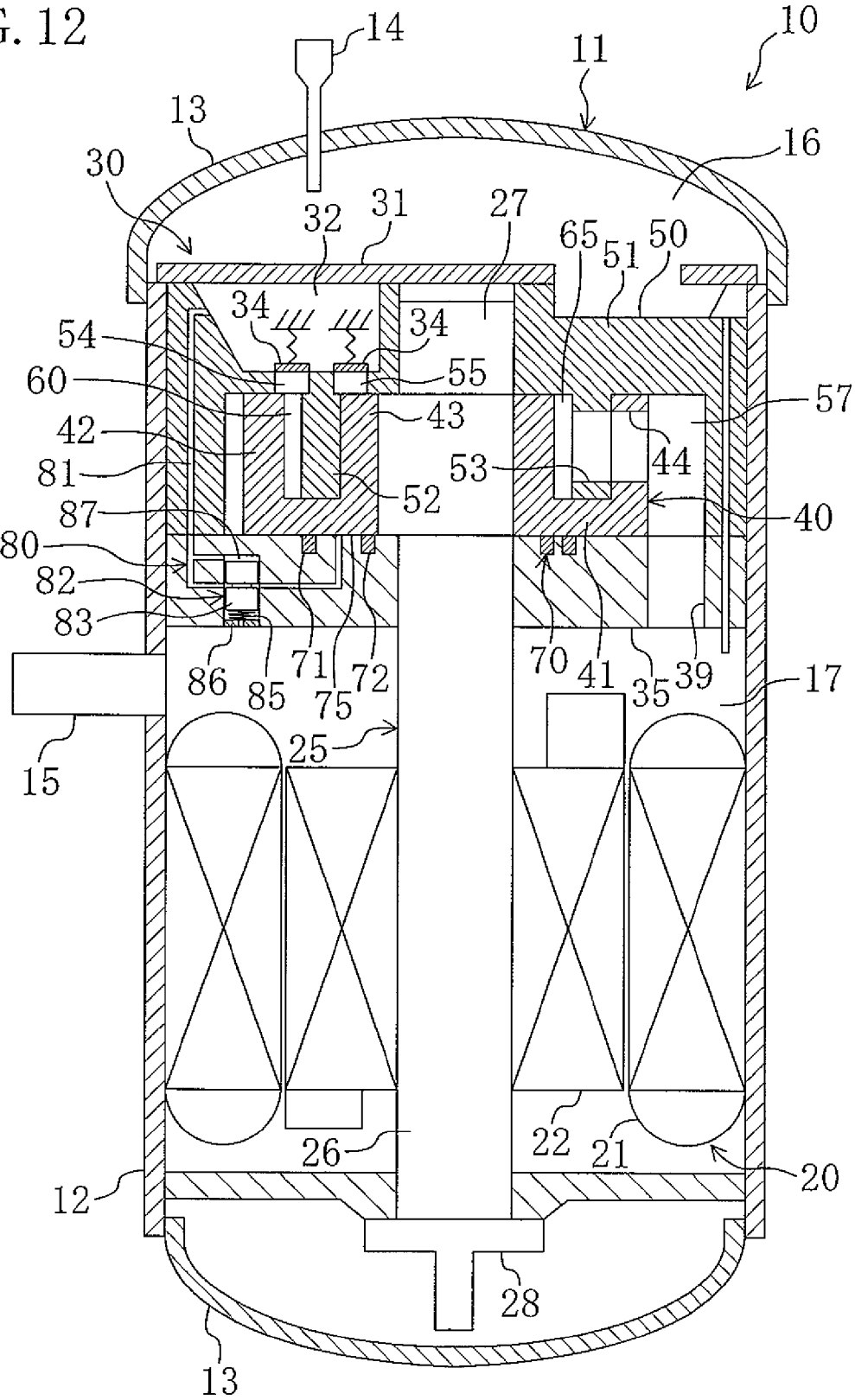
FIG. 12 is a schematic longitudinal cross-sectional view of a rotary compressor according to a third variation of the other embodiment.

In the rotary compressor (10) of each of the foregoing embodiments, it may be arranged such that as shown in FIG. 12, the compression mechanism (30) overlies the electric motor (20). Here, description will be made in regard to the case where the present variation is applied to the first embodiment.

In the rotary compressor (10) of the present variation, the internal space of the casing (11) is partitioned vertically by the compression mechanism (30) into a space above the compression mechanism (30) which space constitutes an upper space (16) and a space below the compression mechanism (30) which space constitutes a lower space (17). The discharge pipe (14) is connected to the upper space (16). The suction pipe (15) is connected to the lower space (17).

In the compression mechanism (30) of the present variation, the first housing (35) is disposed on the lower side (i.e., nearer the electric motor (20)) and the second housing (50) is disposed on the upper side. The first housing (35) is provided with a suction port (39). The suction port (39) brings the suction space (57) into fluid communication with the lower space (17). The second housing (50) is provided with an external discharge port (54) for the external cylinder chamber (60) and an internal discharge port (55) for the internal cylinder chamber (65). These discharge ports (54, 55) are opened and closed by discharge valves (34) formed by reed valves. Refrigerant compressed in the compression mechanism (30) is discharged through the discharge ports (63, 68) to the discharge space (32) within the muffler (31). Thereafter, the refrigerant flows into the upper space (16).

In the compression mechanism (30), the communicating path (81) is formed such that it extends from the second housing (50) to the first housing (35). One end of the communicating path (81) is connected to a portion of the back surface side gap (75) which portion is situated between the large-diameter seal ring (71) and the small-diameter seal ring (72) (i.e., the intermediate gap (77)) while the other end thereof is connected to the discharge space (32). In addition, in the differential pressure regulating valve (82) of the present variation, a space above the valve element (83) in the embedment hole (87) is connected through the communicating path (81) to the discharge space (32).

In the rotary compressor (10), an oil feeding pump (28) is mounted to the lower end of the crank shaft (25). The oil feeding pump (28) is formed by a positive displacement pump. The oil feeding pump (28) draws in refrigeration oil accumulated on the bottom of the casing (11) and supplies the drawn refrigeration oil to the compression mechanism (30).

In the compression mechanism (30), the internal pressure of a portion of the back surface side gap (75) which portion is situated more interior than the small-diameter seal ring (72) (i.e., the internal gap (76)) is placed at the same level as the pressure of the refrigeration oil supplied to the compression mechanism (30). In other words, the internal pressure of the internal gap (76) is substantially equal to the suction pressure of the same level as the internal pressure of the lower space (17). In addition, the pressure of a portion of the back surface side gap (75) which portion is situated more exterior than the large-diameter seal ring (71) (i.e., the external gap (78)) is equal to the internal pressure of the suction space (57), i.e., the suction pressure.

In an operating condition in which the difference between the discharge pressure and the suction pressure is relatively small, the valve element (83) of the differential pressure regulating valve (82) is pushed up by the biasing force of the spring (85) whereby the communicating path (81) is placed in the open state (see FIG. 12). In this state, the discharge space (32) comes into fluid communication with the intermediate gap (77) through the communicating path (81), and the pressure of the intermediate gap (77) is placed at the same level as the suction pressure. Consequently, the area of a portion of the back surface of the cylinder (40) to which portion the discharge pressure is applied expands, and the downward pushing force which is applied to the cylinder (40) becomes larger as compared to when the intermediate gap (77) is placed at the same pressure as the suction pressure.

In such an operating condition in which the difference between the discharge pressure and the suction pressure is relatively small to tend to lack the pushing force which is applied to the cylinder (40), the discharge pressure is introduced into the intermediate gap (77) to thereby ensure the downward load which is applied to the cylinder (40).

On the other hand, in an operating condition in which the difference between the discharge pressure and the suction pressure is relatively great, the valve element (83) of the differential pressure regulating valve (82) overcomes the biasing force of the spring (85) and is pushed down whereby the communicating path (81) is placed in the closed state. And, the intermediate gap (77) is made discontinuous from the discharge space (32), and the pressure of the intermediate gap (77) gradually falls to be finally placed at the same level as the suction pressure. In other words, since the occurrence of fluid leakage cannot be prevented completely by the large- and small-diameter seal rings (71, 72), the pressure of the intermediate gap (77) comes to have the same value as the pressure of the internal gap (76) and the pressure of the external gap (78). Consequently, the suction pressure is applied to the entire back surface of the cylinder (40), as a result of which the downward force which is applied to the cylinder (40) becomes smaller as compared to when the intermediate gap (77) is placed at the same pressure as the discharge pressure.

In such an operating condition in which the difference between the discharge pressure and the suction pressure is relatively great to make the pushing force which is applied to the cylinder (40) liable to be excessive, the pressure of the intermediate gap (77) is placed at the same level as the suction pressure to thereby reduce the downward load which is applied to the cylinder (40).

Fourth Variation

In the compression mechanism (30) of each of the foregoing embodiments, it is configured such that the second housing (50) provided with the piston main body (52) is made stationary while on the other hand the cylinder (40) is eccentrically rotated. Conversely, it may be configured such that the cylinder (40) is made stationary while on the other hand the second housing (50) provided with the piston main body (52) is eccentrically rotated. In this arrangement, the pressing mechanism (70) applies pushing force to the second housing (50) provided with the piston main body (52). That is, in this case, the second housing (50) serves as a pushing side member and the cylinder (40) serves as a receiving side member.

It should be noted that the above-descried embodiments are essentially preferable exemplifications which are not intended in any sense to limit the scope of the present invention, its application, or its application range.

INDUSTRIAL APPLICABILITY

As has been described above, the present invention finds its utility in the field of rotary compressors configured to compress fluid by relative eccentric rotation of a cylinder and a piston.

What is claimed is:

1. A rotary compressor comprising:

a cylinder including a base end side with an end plate part having a front surface, the cylinder defining a cylinder chamber;

a piston including a base end side with an end plate part having a front surface that faces the front surface of the end plate part of the cylinder across the cylinder chamber, the piston being disposed in an eccentric manner relative to the cylinder in the cylinder chamber;

a blade dividing the cylinder chamber into a high pressure chamber and a low pressure chamber with a volume of the high pressure chamber and a volume of the low pressure chamber being varied by relative eccentric movement between the cylinder and the piston;

a pressing mechanism operatively coupled to one of the cylinder and the piston that constitutes a pushing side member, with the pushing side member being selectively pushable towards the end plate part of the other of the cylinder and the piston that constitutes a receiving side member; and an adjusting mechanism varying a magnitude of a load which is applied in a direction towards the end plate part of the receiving side member to the pushing side member in response to a pressure differential between a suction fluid drawn in to the low pressure chamber and a discharge fluid discharged from the high pressure chamber.

2. The rotary compressor of claim 1, wherein the cylinder is configured such that the cylinder chamber has a transverse cross-section that is ring shaped;

the piston includes a piston main body that is ring shaped to divide the cylinder chamber into an external cylinder chamber outside the piston and an internal cylinder chamber inside the piston; and the external and internal cylinder chambers are each divided by the blade into the high and low pressure chambers.

3. The rotary compressor of claim 1, wherein the adjusting mechanism varies a magnitude of a pushing force which is applied to the pushing side member by the pressing mechanism such that the magnitude of the load which is applied in the direction towards the end plate part of the receiving side member to the pushing side member is varied.

4. The rotary compressor of claim 3, wherein the pressing mechanism is configured such that pressure of the discharge fluid is applied to one portion of a back surface of the end plate part of the pushing side member while pressure of the suction fluid is applied to another portion of the end plate part; and the adjusting mechanism varies an area of the portion of the back surface of the end plate part of the pushing side member to which the pressure of the discharge fluid is applied such that the magnitude of the pushing force applied to the pushing side member by the pressing mechanism is varied.

5. The rotary compressor of claim 4, further comprising a supporting member disposed along the back surface of the end plate part of the pushing side member to define a back surface side gap between the supporting member and entirely along the back surface of the end plate part of the pushing side member;

the pressing mechanism including a large-diameter seal ring and a small-diameter seal ring which are formed in respective ring shapes of different diameters and which are disposed in the back surface side gap, such that the pressure of the discharge fluid is constantly applied to a portion of the back surface side gap which is defined inside the small-diameter seal ring while the pressure of the suction fluid is constantly applied to a portion of the back surface side gap which is defined outside the large-diameter seal ring; and the adjusting mechanism including:

a communicating path connecting a portion of the back surface side gap defined between the small-diameter seal ring and the large-diameter seal ring to a space where the discharge fluid is present; and an on-off valve selectively opening the communicating path if the pressure differential between the discharge fluid and the suction fluid falls below a predetermined value and selectively closing the communicating path if the pressure differential becomes equal to or greater than the predetermined value.

6. The rotary compressor of claim 5, wherein the large-diameter seal ring and the small-diameter seal ring have centers lying nearer the high pressure chamber than a center of rotation of either the cylinder or the piston and the center of the small-diameter seal ring lies nearer the blade than the center of the large-diameter seal ring.

7. The rotary compressor of claim 1, further comprising a supporting member disposed along the back surface of the end plate part of the pushing side member to define a back surface side gap between the supporting member and entirely along the back surface of the end plate part of the pushing side member;

the pressing mechanism being configured such that the pushing side member is pushed towards the end plate part of the receiving side member by fluid pressure in the back surface side gap;

the pressing mechanism including a large-diameter seal ring and a small-diameter seal ring which are formed in respective ring shapes of different diameters and which are disposed in the back surface side gap; and the adjusting mechanism varying fluid pressure in a portion of the back surface side gap which is defined between the small-diameter seal ring and the large-diameter seal ring such that the magnitude of pushing force which is applied to the pushing side member by the pressing mechanism is varied.

8. The rotary compressor of claim 7, wherein the large-diameter seal ring has a center lying nearer the high pressure chamber than a center of rotation of either the cylinder or the piston.

9. The rotary compressor of claim 1, wherein the adjusting mechanism causes a pushing-back force in the direction away from the end plate part of the receiving side member to be applied to the pushing side member, and varies a magnitude of the pushing-back force to vary the magnitude of the load which is applied in the direction towards the end plate part of the receiving side member to the pushing side member.

10. The rotary compressor of claim 9, wherein the adjusting mechanism includes a concave groove which opens at a tip surface of the receiving side member which comes into sliding contact with the front surface of the end plate part of the pushing side member such that an internal pressure of the concave groove is varied to vary the magnitude of the pushing-back force.

11. The rotary compressor of claim 10, wherein the concave groove of the adjusting mechanism is opened at a portion of the tip surface of the receiving side member which is situated nearer the low pressure chamber; and the adjusting mechanism includes:

a communicating path connecting the concave groove to a space where the discharge fluid is present; and an on-off valve selectively opening the communicating path if the pressure differential between the discharge fluid and the suction fluid exceeds a predetermined value and selectively closing the communicating path if the pressure differential becomes equal to or less than the predetermined value.

12. The rotary compressor of claim 10, wherein the concave groove of the adjusting mechanism is opened at a portion of the tip surface of the receiving side member which is situated nearer the high pressure chamber; and the adjusting mechanism includes:

a communicating path connecting the concave groove to a space where the discharge fluid is present; and an on-off valve selectively opening the communicating path if the pressure differential between the discharge fluid and the suction fluid falls below a predetermined value and selectively closing the communicating path if the pressure differential becomes equal to or greater than the predetermined value.

* * * * *